US011276926B2

(12) United States Patent
Yun et al.

(10) Patent No.: US 11,276,926 B2
(45) Date of Patent: Mar. 15, 2022

(54) ANTENNA AND ELECTRONIC DEVICE INCLUDING THE SAME

(71) Applicant: Samsung Electronics Co., Ltd., Suwon-si (KR)

(72) Inventors: Sumin Yun, Suwon-si (KR); Dongyeon Kim, Suwon-si (KR); Seongjin Park, Suwon-si (KR); Woomin Jang, Suwon-si (KR); Myunghun Jeong, Suwon-si (KR); Jehun Jong, Suwon-si (KR); Jaehoon Jo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 16 days.

(21) Appl. No.: 16/812,766

(22) Filed: Mar. 9, 2020

(65) Prior Publication Data

US 2020/0295454 A1 Sep. 17, 2020

(30) Foreign Application Priority Data

Mar. 15, 2019 (KR) ..... 10-2019-0029704

(51) Int. Cl.
*H01Q 1/24* (2006.01)
*H01Q 1/52* (2006.01)
(Continued)

(52) U.S. Cl.
CPC ..... *H01Q 1/523* (2013.01); *H01Q 1/243* (2013.01); *H01Q 1/38* (2013.01); *H01Q 1/48* (2013.01);
(Continued)

(58) Field of Classification Search
CPC ..... H01Q 1/2283; H01Q 1/38; H01Q 1/243; H01Q 1/523; H01Q 21/065
See application file for complete search history.

(56) References Cited

U.S. PATENT DOCUMENTS 6,211,824 B1 4/2001 Holden et al.
10,741,906 B2 8/2020 Gomez Angulo et al.
(Continued)

FOREIGN PATENT DOCUMENTS

CN 206098713 U 4/2017
JP 3982694 B2 9/2007
(Continued)

OTHER PUBLICATIONS

International Search Report dated Jun. 18, 2020, issued in International Application No. PCT/KR2020/003226.
(Continued)

*Primary Examiner* — Hasan Islam
(74) *Attorney, Agent, or Firm* — Jefferson IP Law, LLP

(57) ABSTRACT

An electronic device is provided. The electronic device includes a housing including a first plate, a second plate facing a direction opposite to the first plate, and a lateral member surrounding a space between the first and second plates and connected to or integrally formed with the second plate. The electronic device further includes a display disposed in the space so as to be visible from outside through at least a part of the first plate, and at least one antenna structure disposed in the space, including a first surface and a second surface facing a direction opposite to the first surface, and including a first area and a second area surrounded by the first area when viewed from above the first surface. The antenna structure may also include a plurality of insulating layers disposed between the first and second surfaces, first conductive patches disposed in the first area, when viewed from above the first surface, and disposed on the first surface or on a first insulating layer closer to the first surface than the second surface, a second conductive patch overlapped at least in part with the second area, when viewed from above the first surface, and disposed on a
(Continued)

second insulating layer between the first insulating layer and the second surface, a ground layer disposed on a third insulating layer between the second insulating layer and the second surface or on the second surface, and one or more conductive walls formed along at least a portion of an outer periphery of the first area, when viewed from above the first surface, and extended from the first insulating layer to the ground layer. The electronic device includes at least one wireless communication circuit electrically connected to the second conductive patch and configured to at least one of transmit or receive a signal having a frequency between about 3 GHz and about 100 GHz.

18 Claims, 33 Drawing Sheets

(51) Int. Cl.

| | |
|---|---|
| ***H01Q 1/38*** | (2006.01) |
| ***H01Q 1/48*** | (2006.01) |
| ***H01Q 1/50*** | (2006.01) |
| ***H01Q 15/00*** | (2006.01) |
| ***H01Q 21/00*** | (2006.01) |
| ***H01Q 21/06*** | (2006.01) |

(52) U.S. Cl.
CPC ..... *H01Q 1/50* (2013.01); *H01Q 15/006* (2013.01); *H01Q 21/0068* (2013.01); *H01Q 21/065* (2013.01)

(56) References Cited

U.S. PATENT DOCUMENTS

| | | | | |
|---|---|---|---|---|
| 2008/0068269 | A1 | 3/2008 | Yamada | |
| 2012/0162015 | A1 | 6/2012 | Chen et al. | |
| 2016/0049723 | A1* | 2/2016 | Baks ..... | H01Q 1/2291 343/848 |
| 2016/0056544 | A1 | 2/2016 | Garcia et al. | |
| 2017/0222316 | A1 | 8/2017 | Mizunuma et al. | |
| 2018/0219272 | A1 | 8/2018 | Baheti et al. | |
| 2019/0020100 | A1 | 1/2019 | Jong et al. | |

FOREIGN PATENT DOCUMENTS

| | | | |
|---|---|---|---|
| JP | 4620018 | B2 | 11/2010 |
| JP | 6402310 | B2 | 9/2018 |

OTHER PUBLICATIONS

Extended European Search Report dated Aug. 10, 2020, issued in European Application No. 20161753.7-1205.

* cited by examiner

ANTENNA AND ELECTRONIC DEVICE INCLUDING THE SAME

CROSS-REFERENCE TO RELATED APPLICATION(S)

This application is based on and claims priority under 35 U.S.C. § 119(a) of a Korean patent application number 10-2019-0029704, filed on Mar. 15, 2019, in the Korean Intellectual Property Office, the disclosure of which is incorporated by reference herein in its entirety.

BACKGROUND

1. Field

The disclosure relates to an antenna and an electronic device including the same.

2. Description of Related Art

With the development of wireless communication technology, communication electronic devices are commonly used in daily life, thereby exponentially increasing the use of contents. Accordingly, a network capacity limit may be nearing exhaustion. After commercialization of 4th generation (4G) communication systems, in order to meet growing wireless data traffic demand, a communication system (e.g., 5th generation (5G), pre-5G communication system, or new radio (NR)) that transmits and/or receives signals using a frequency of a high frequency (e.g., millimeter wave (mm-Wave)) band (e.g., 3 gigahertz (GHz) to 300 GHz band) is being developed.

Next-generation wireless communication technologies are currently developed to permit signal transmission/reception using frequencies in the range of 3 GHz to 100 GHz, overcome a high free space loss due to frequency characteristics, implement an efficient mounting structure for increasing an antenna gain, and realize a related new structure of an antenna.

The antenna that operates in the above-mentioned operating frequency band may include, as an antenna element, at least one conductive patch capable of easily implementing a high gain and a dual polarization. However, because of a position relatively close to a ground of a printed circuit board, it may be difficult to implement a wide bandwidth. In order to solve this problem, a conductive radiator having a certain shape and size may be disposed for coupling around the conductive patch. For example, the conductive radiator may be disposed at a position capable of coupling with the conductive patch, and may be formed of a conductive plate having a shape and size similar to that of the conductive patch or composed of a plurality of conductive patches arranged to have a periodic structure at regular intervals around the conductive patch.

Although being able to implement a wide band, this antenna structure to which the conductive plate is applied may be confronted with a reduction in radiation efficiency because the resonance is formed in an operating frequency band as opposed to a resonance mode of the conductive patch. In case where the conductive patches are applied, a design for tuning to a desired frequency band is difficult, and also an isolation property may be reduced due to an increase in the effective size of the antenna.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an antenna and an electronic device including the same.

Another aspect of the disclosure is to provide an antenna that is relatively easy to design, and an electronic device including the same.

Another aspect of the disclosure is to provide an antenna having an improved isolation property to operate in a wide bandwidth and prevent a radiation efficiency from being reduced, and an electronic device including the same.

Additional aspects will be set forth in part in the description which follows and, in part, will be apparent from the description, or may be learned by practice of the presented embodiments.

In accordance with an aspect of the disclosure, an electronic device is provided. The electronic device includes a housing including a first plate, a second plate facing a direction opposite to the first plate, and a lateral member surrounding a space between the first plate and the second plate and connected to or integrally formed with the second plate. The electronic device may further include a display disposed in the space of the housing so as to be visible from outside the housing through at least a part of the first plate, and at least one antenna structure disposed in the space of the housing, including a first surface and a second surface facing a direction opposite to the first surface, and including a first area and a second area surrounded by the first area when viewed from above the first surface. The antenna structure may also include a plurality of insulating layers disposed between the first surface and the second surface, first conductive patches disposed in the first area, when viewed from above the first surface, and disposed on the first surface or on a first insulating layer closer to the first surface than the second surface, a second conductive patch overlapped at least in part with the second area, when viewed from above the first surface, and disposed on a second insulating layer between the first insulating layer and the second surface, a ground layer disposed on a third insulating layer between the second insulating layer and the second surface or on the second surface, and one or more conductive walls formed along at least a portion of an outer periphery of the first area, when viewed from above the first surface, and extended from the first insulating layer to the ground layer. The electronic device may further include at least one wireless communication circuit electrically connected to the second conductive patch and configured to at least one of transmit or receive a signal having a frequency between about 3 GHz and about 100 GHz.

In accordance with another aspect of the disclosure, an electronic device is provided. The electronic device includes a housing including a first plate, a second plate facing a direction opposite to the first plate, and a lateral member surrounding a space between the first plate and the second plate and connected to or integrally formed with the second plate, a printed circuit board disposed in the space of the housing, including a first surface and a second surface facing a direction opposite to the first surface, and including a first area and a second area surrounded by the first area when viewed from above the first surface, a plurality of insulating layers disposed between the first surface and the second surface, first conductive patches overlapped at least in part with the first area, when viewed from above the first surface, and exposed to the first surface or disposed on an insulating layer closer to the first surface between the first surface and the second surface, a second conductive patch overlapped at least in part with the second area, when viewed from above the first surface, and disposed on an insulating layer, at least one ground layer disposed on the second surface or on an insulating layer between the second conductive patch and the second surface, one or more conductive walls extended from at least a portion of an outer periphery of the first area, when viewed from above the first surface, and disposed at a position so as to be capacitively coupled with the first conductive patches, and at least one wireless communication circuit electrically connected to the second conductive patch through the plurality of insulating layers and configured to at least one of transmit or receive a signal having a frequency between about 3 GHz and about 100 GHz.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
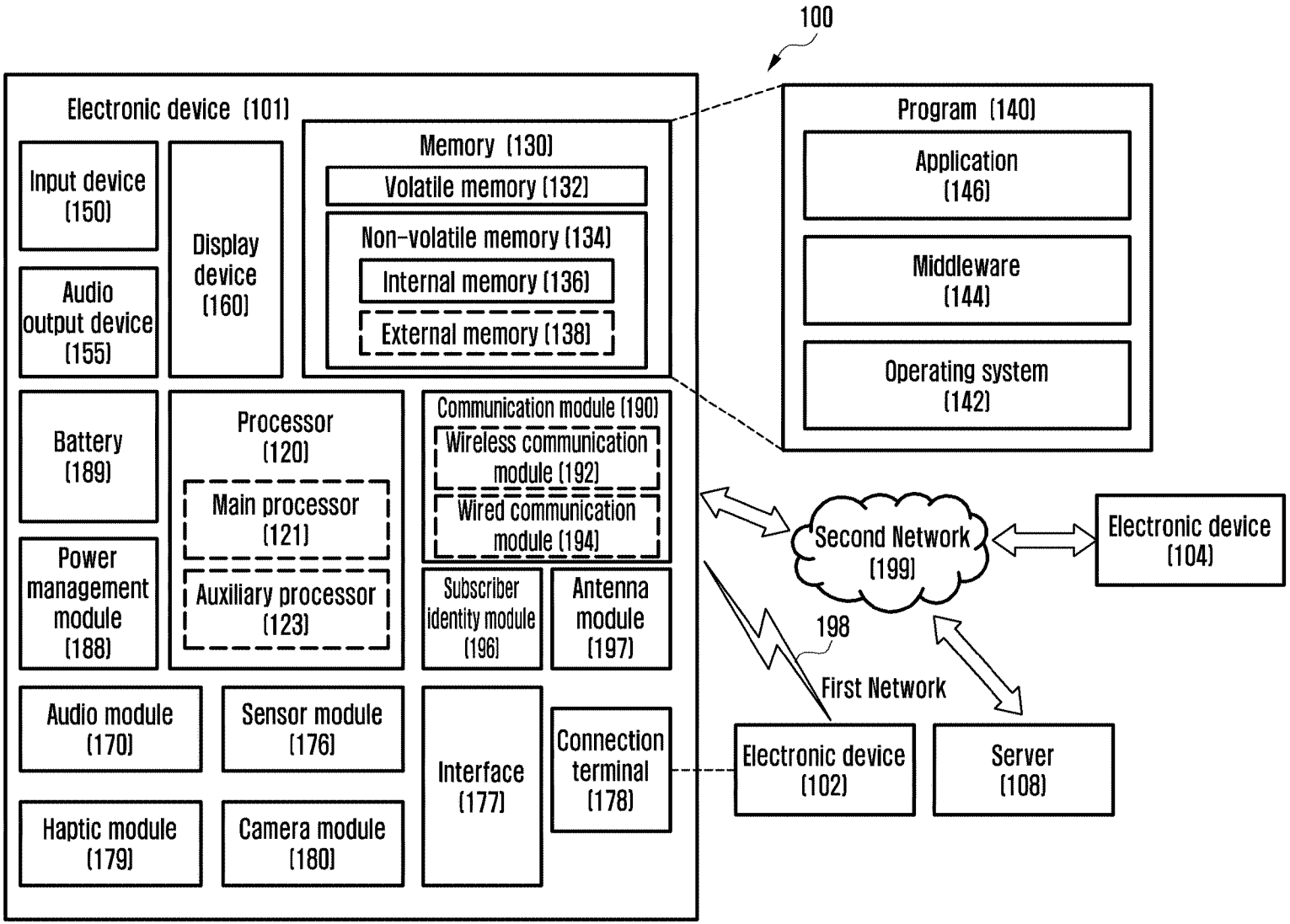
FIG. 1 is a block diagram illustrating an electronic device in a network environment according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

With regard to the description of the drawings, similar reference numerals may be used to refer to similar or related elements.

As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases.

As used herein, such terms as "1st" and "2nd", or "first" and "second" may be used to distinguish a corresponding component from another, and does not limit the components in another aspect, such as importance or order. If an element, such as a first element, is referred to, with or without the term "operatively" or "communicatively", as "coupled with", "coupled to", "connected with", or "connected to" another element, such as a second element, this indicates that the first element may be coupled with the second element directly (e.g., wiredly), wirelessly, or via a third element.

FIG. 1 illustrates an electronic device in a network environment according to an embodiment of the disclosure.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). The electronic device 101 may communicate with the electronic device 104 via the server 108. The electronic device 101 includes a processor 120, memory 130, an input device 150, an audio output device 155, a display device 160, an audio module 170, a sensor module 176, an interface 177, a haptic module 179, a camera module 180, a power management module 188, a battery 189, a communication module 190, a subscriber identification module (SIM) 196, and an antenna module 197. At least one of the components may be omitted from the electronic device 101, or one or more other components may be added in the electronic device 101. Some of the components may be implemented as single integrated circuitry. For example, the sensor module 176 may be implemented as embedded in the display device 160.

The processor 120 may execute a program 140 to control at least one other hardware or software component of the electronic device 101 coupled with the processor 120, and may perform various data processing or computation. As at least part of the data processing or computation, the processor 120 may load a command or data received from another component in volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component among the components of the electronic device 101, instead of the main processor 121 while the main processor 121 is in an inactive (e.g., sleep) state, or together with the main processor 121 while the main processor 121 is in an active state. The auxiliary processor 123 (e.g., an image signal processor (ISP) or a CP) may be implemented as part of another component (e.g., the camera module 180 or the communication module 190) functionally related to the auxiliary processor 123.

The memory 130 may store various data used by at least one component of the electronic device 101, such as the program 140 and input data or output data for a command related thereto. The memory 130 may include the volatile memory 132 or the non-volatile memory 134.

The program 140 may be stored in the memory 130 as software and may include an operating system (OS) 142, middleware 144, and applications 146.

The input device 150 may receive a command or data to be used by the processor 120 of the electronic device 101, from the outside (e.g., a user) of the electronic device 101. The input device 150 may include a microphone, a mouse, a keyboard, or a digital pen.

The audio output device 155 may output sound signals to the outside of the electronic device 101 and may include a speaker or a receiver. The speaker may be used for general purposes, such as playing multimedia or playing record, and the receiver may be used for receiving incoming calls. The receiver may be implemented as separate from, or as part of the speaker.

The display device 160 may visually provide information to the outside (e.g., a user) of the electronic device 101. The display device 160 may include a display, a hologram device, or a projector and control circuitry to control a corresponding one of the display, hologram device, and projector. The display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. The audio module 170 may obtain the sound via the input device 150, or output the sound via the audio output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. The sensor module 176 may include a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, and an illuminance sensor.

The interface 177 may support one or more specified protocols to be used for the electronic device 101 to be coupled with the external electronic device 102 directly (e.g., wiredly) or wirelessly. The interface 177 may include a high definition multimedia interface (HDMI), a universal serial bus (USB) interface, a secure digital (SD) card interface, or an audio interface.

A connection terminal 178 may include a connector via which the electronic device 101 may be physically connected with the external electronic device 102. The connection terminal 178 may include an HDMI connector, a USB connector, an SD card connector, or an audio connector.

The haptic module 179 may convert an electrical signal into a mechanical stimulus (e.g., a vibration or a movement) or electrical stimulus which may be recognized by a user via his tactile sensation or kinesthetic sensation. The haptic module 179 may include a motor, a piezoelectric element, or an electric stimulator.

The camera module 180 may capture a still image or moving images. The camera module 180 may include one or more lenses, image sensors, image signal processors, or flashes.

The power management module 188 may manage power supplied to the electronic device 101. The power management module 188 may be implemented as at least part of a power management integrated circuit (PMIC).

The battery 189 may supply power to at least one component of the electronic device 101 and may include a primary cell which is not rechargeable, a secondary cell which is rechargeable, or a fuel cell.

The communication module 190 may support establishing a direct communication channel or a wireless communication channel between the electronic device 101 and the external electronic device and performing communication via the established communication channel. The communication module 190 may include one or more communication processors that are operable independently from the processor 120 (e.g., the AP) and supports a direct communication or a wireless communication. The communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, Wi-Fi direct, or infrared data association (IrDA)) or the second network 199 (e.g., a long-range communication network, such as a cellular network, the Internet, or a computer network (e.g., LAN or wide area network (WAN)).

These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., an international mobile subscriber identity (IMSI)) stored in the SIM 196.

The antenna module 197 may transmit or receive a signal or power to or from the external electronic device. The antenna module 197 may include an antenna including a radiating element composed of a conductive material or a conductive pattern formed in or on a substrate (e.g., a printed circuit board (PCB)). The antenna module 197 may include a plurality of antennas. In such a case, at least one antenna appropriate for a communication scheme used in the communication network, such as the first network 198 or the second network 199, may be selected by the communication module 190 from the plurality of antennas. The signal or the power may then be transmitted or received between the communication module 190 and the external electronic device via the selected at least one antenna. Another component (e.g., a radio frequency integrated circuit (RFIC)) other than the radiating element may be additionally formed as part of the antenna module 197.

At least some of the above-described components may be coupled mutually and communicate signals therebetween via an inter-peripheral communication scheme (e.g., a bus, general purpose input and output (GPIO), serial peripheral interface (SPI), or mobile industry processor interface (MIPI)).

Commands or data may be transmitted or received between the electronic device 101 and the external electronic device 104 via the server 108 coupled with the second network 199. Each of the electronic devices 102 and 104 may be a same type as, or a different type, from the electronic device 101. All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud, distributed, or client-server computing technology may be used, for example.

An electronic device according to an embodiment may be one of various types of electronic devices, including, but not limited to a portable communication device (e.g., a smart phone), a computer device, a portable multimedia device, a portable medical device, a camera, a wearable device, or a home appliance. However, the electronic device is not limited to any of those described above.

Various embodiments of the disclosure and the terms used herein are not intended to limit the technological features set forth herein to particular embodiments and include various changes, equivalents, or replacements for a corresponding embodiment.

With regard to the description of the drawings, similar reference numerals may be used to refer to similar or related elements.

A singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases.

As used herein, such terms as "1st" and "2nd", or "first" and "second" may be used to simply distinguish a corresponding component from another, and does not limit the components in other aspect (e.g., importance or order). If an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

The term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

A method according to an embodiment of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Each component (e.g., a module or a program) of the above-described components may include a single entity or multiple entities. One or more of the above-described components may be omitted, or one or more other components may be added. Alternatively or additionally, a plurality of components (e.g., modules or programs) may be integrated into a single component. In such a case, the integrated component may still perform one or more functions of each of the plurality of components in the same or similar manner as they are performed by a corresponding one of the plurality of components before the integration. Operations performed by the module, the program, or another component may be carried out sequentially, in parallel, repeatedly, or heuristically, or one or more of the operations may be executed in a different order or omitted, or one or more other operations may be added.

Figure 2:
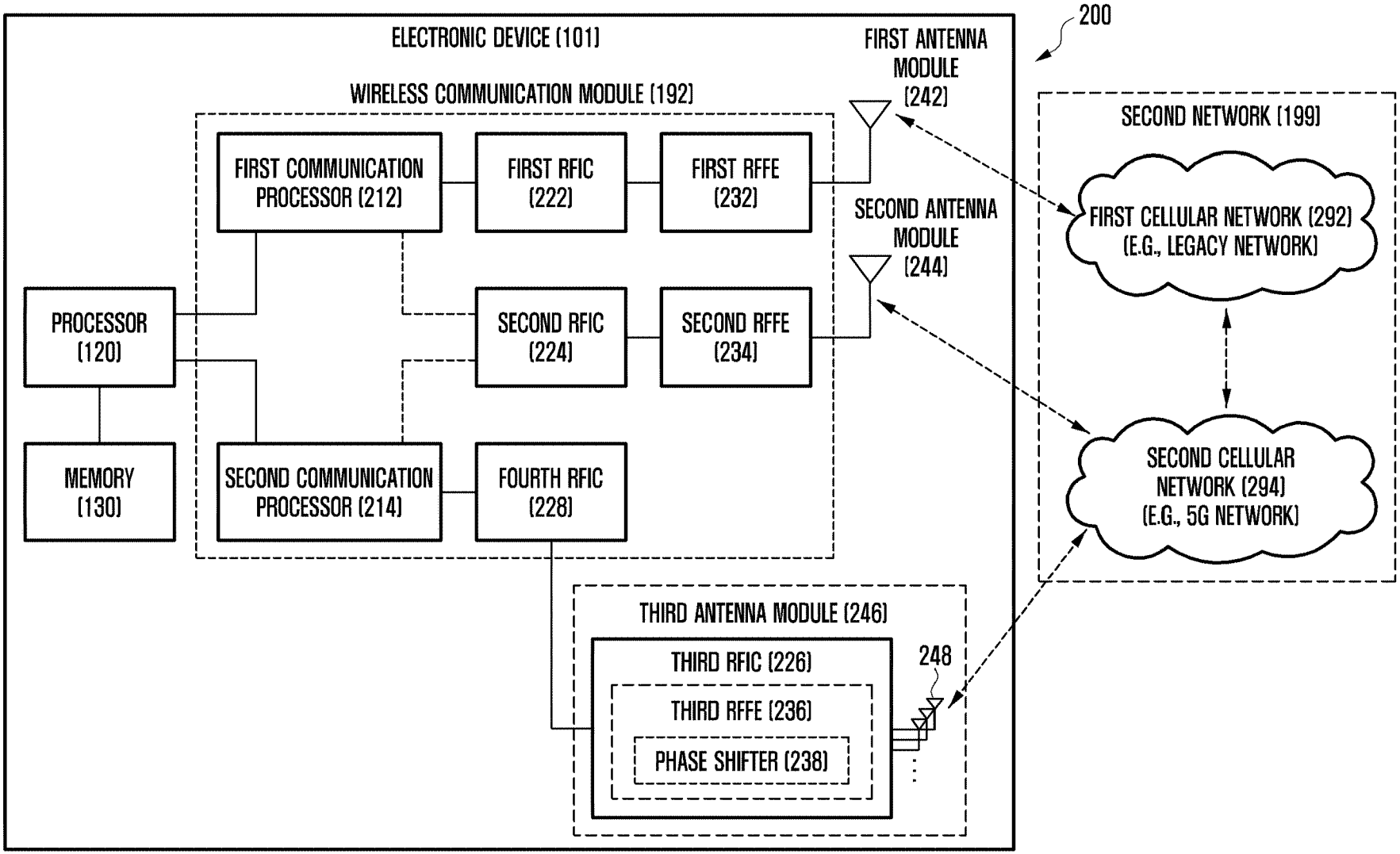
FIG. 2 is a block diagram illustrating an electronic device for supporting a legacy network communication and a 5G network communication according to an embodiment of the disclosure.

FIG. 2 illustrates an electronic device 101 in a network environment 200 including a plurality of cellular networks according to an embodiment of the disclosure.

Referring to FIG. 2, the electronic device 101 includes a first communication processor 212, second communication processor 214, first RFIC 222, second RFIC 224, third RFIC 226, fourth RFIC 228, first radio frequency front end (RFFE) 232, second RFFE 234, first antenna module 242, second antenna module 244, antenna 248, processor 120, and memory 130. A second network 199 includes a first cellular network 292 and a second cellular network 294. The electronic device 101 may further include at least one of the components described with reference to FIG. 1, and the second network 199 may further include at least one other network. The first communication processor 212, second communication processor 214, first RFIC 222, second RFIC 224, fourth RFIC 228, first RFFE 232, and second RFFE 234 may form at least part of the wireless communication module 192. The fourth RFIC 228 may be omitted or included as part of the third RFIC 226.

The first communication processor 212 may establish a communication channel of a band to be used for wireless communication with the first cellular network 292 and support legacy network communication through the established communication channel. The first cellular network may be a legacy network including a second generation (2G), 3G, 4G, or long term evolution (LTE) network. The second communication processor 214 may establish a communication channel corresponding to a designated band (e.g., about 6 GHz to about 60 GHz) of bands to be used for wireless communication with the second cellular network 294, and support 5G network communication through the established communication channel. The second cellular network 294 may be a 5G network defined in the 3G partnership project (3GPP).

The first communication processor 212 or the second communication processor 214 may establish a communication channel corresponding to another designated band (e.g., about 6 GHz or less) of bands to be used for wireless communication with the second cellular network 294 and support 5G network communication through the established communication channel. The first communication processor 212 and the second communication processor 214 may be implemented in a single chip or a single package. The first communication processor 212 or the second communication processor 214 may be formed in a single chip or a single package with the processor 120, the auxiliary processor 123, or the communication module 190.

Upon transmission, the first RFIC 222 may convert a baseband signal generated by the first communication processor 212 to a radio frequency (RF) signal of about 700 MHz to about 3 GHz used in the first cellular network 292 (e.g., legacy network). Upon reception, an RF signal may be obtained from the first cellular network 292 through the first antenna module 242 and be preprocessed through the first RFFE 232. The first RFIC 222 may convert the preprocessed RF signal to a baseband signal so as to be processed by the first communication processor 212.

Upon transmission, the second RFIC 224 may convert a baseband signal generated by the first communication processor 212 or the second communication processor 214 to an RF signal (hereinafter, 5G Sub6 RF signal) of a Sub6 band (e.g., 6 GHz or less) to be used in the second cellular network 294 (e.g., 5G network).

Upon reception, a 5G Sub6 RF signal may be obtained from the second cellular network 294 (e.g., 5G network) through the second antenna module 244 and be pretreated through the second RFFE 234. The second RFIC 224 may convert the preprocessed 5G Sub6 RF signal to a baseband signal so as to be processed by a corresponding communication processor of the first communication processor 212 or the second communication processor 214.

The third RFIC 226 may convert a baseband signal generated by the second communication processor 214 to an RF signal (hereinafter, 5G Above6 RF signal) of a 5G Above6 band (e.g., about 6 GHz to about 60 GHz) to be used in the second cellular network 294 (e.g., 5G network). Upon reception, a 5G Above6 RF signal may be obtained from the second cellular network 294 through the antenna 248 and be preprocessed through the third RFFE 236. The third RFIC 226 may convert the preprocessed 5G Above6 RF signal to a baseband signal so as to be processed by the second communication processor 214. The third RFFE 236 may be formed as part of the third RFIC 226.

The electronic device 101 may include a fourth RFIC 228 separately from the third RFIC 226 or as at least part of the third RFIC 226. In this case, the fourth RFIC 228 may convert a baseband signal generated by the second communication processor 214 to an RF signal (hereinafter, an intermediate frequency (IF) signal) of an intermediate frequency band (e.g., about 9 GHz to about 11 GHz) and transfer the IF signal to the third RFIC 226. The third RFIC 226 may convert the IF signal to a 5G Above 6RF signal. Upon reception, the 5G Above 6RF signal may be received from the second cellular network 294 through the antenna 248 and be converted to an IF signal by the third RFIC 226. The fourth RFIC 228 may convert an IF signal to a baseband signal so as to be processed by the second communication processor 214.

The first RFIC 222 and the second RFIC 224 may be implemented into at least part of a single package or a single chip. The first RFFE 232 and the second RFFE 234 may be implemented into at least part of a single package or a single chip. At least one of the first antenna module 242 and the second antenna module 244 may be omitted or may be combined with another antenna module to process RF signals of a corresponding plurality of bands.

The third RFIC 226 and the antenna 248 may be disposed at the same substrate to form a third antenna module 246. For example, the wireless communication module 192 or the processor 120 may be disposed at a first substrate (e.g., main printed circuit board (PCB)). The third RFIC 226 is disposed in a partial area (e.g., lower surface) of the first substrate and a separate second substrate (e.g., sub PCB), and the antenna 248 is disposed in another partial area (e.g., upper surface) of the first substrate and a separate second substrate, thereby forming the third antenna module 246. By disposing the third RFIC 226 and the antenna 248 in the same substrate, a length of a transmission line therebetween can be reduced. This may reduce a loss (e.g., attenuation) of a signal of a high frequency band (e.g., about 6 GHz to about 60 GHz) to be used in 5G network communication by a transmission line. Therefore, the electronic device 101 may improve a quality or speed of communication with the second cellular network 294.

The antenna 248 may be formed in an antenna array including a plurality of antenna elements that may be used for beamforming. In this case, the third RFIC 226 may include a plurality of phase shifters 238 corresponding to a plurality of antenna elements as part of the third RFFE 236. Upon transmission, each of the plurality of phase shifters 238 may convert a phase of a 5G Above6 RF signal to be transmitted to the outside (e.g., a base station of a 5G network) of the electronic device 101 through a corresponding antenna element. Upon reception, each of the plurality of phase shifters 238 may convert a phase of the 5G Above6 RF signal received from the outside to the same phase or substantially the same phase through a corresponding antenna element. This enables transmission or reception through beamforming between the electronic device 101 and the outside.

The second cellular network 294 may operate (e.g., standalone (SA)) independently of the first cellular network 292 (e.g., legacy network) or may be operated (e.g., non-standalone (NSA)) in connection with the first cellular network 292. For example, the 5G network may have only an access network (e.g., 5G radio access network (RAN) or a next generation (NG) RAN and have no next generation core (NGC). After accessing to the access network of the 5G network, the electronic device 101 may access to an external network (e.g., Internet) under the control of a core network (e.g., an evolved packed core (EPC)) of the legacy network. LTE protocol information for communication with a legacy network or new radio (NR) protocol information for communication with a 5G network may be stored in the memory 130 to be accessed by the processor 120, the first communication processor 212, or the second communication processor 214.

Figure 3A:
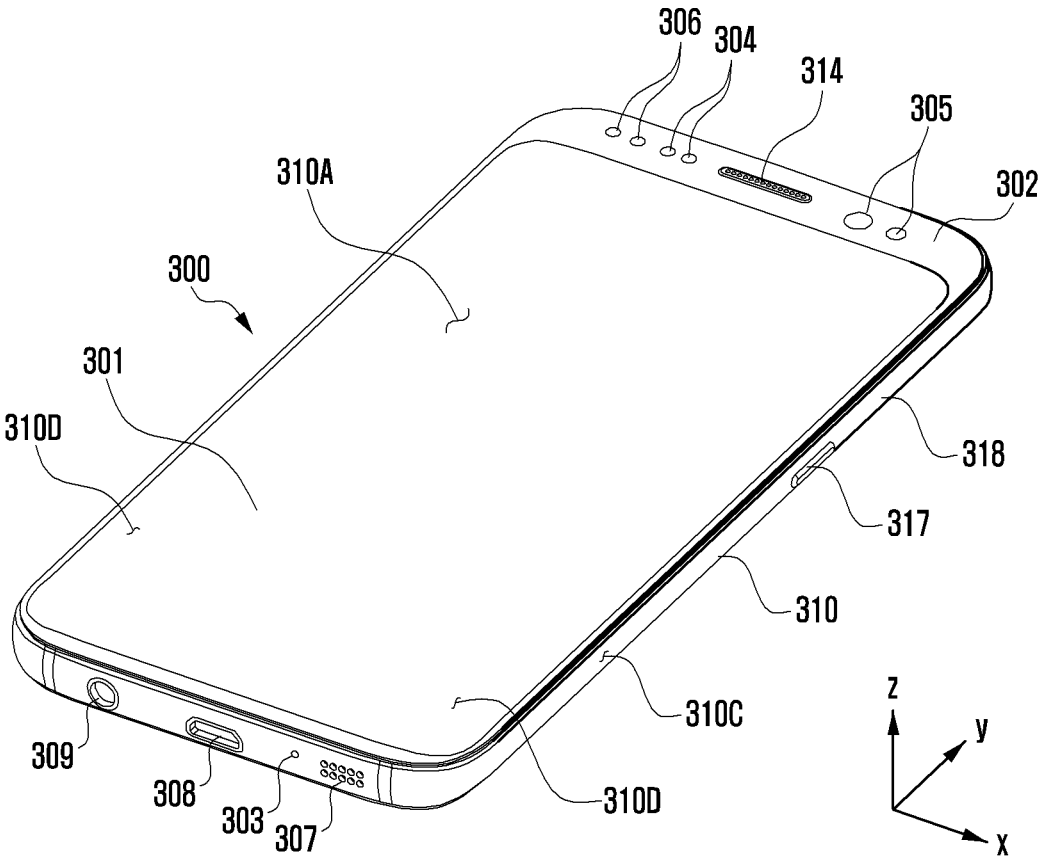
FIG. 3A is a perspective view showing a front surface of a mobile electronic device according to an embodiment of the disclosure.

FIG. 3A is a front perspective view illustrating a mobile electronic device 300 according to an embodiment of the disclosure.

Figure 3B:
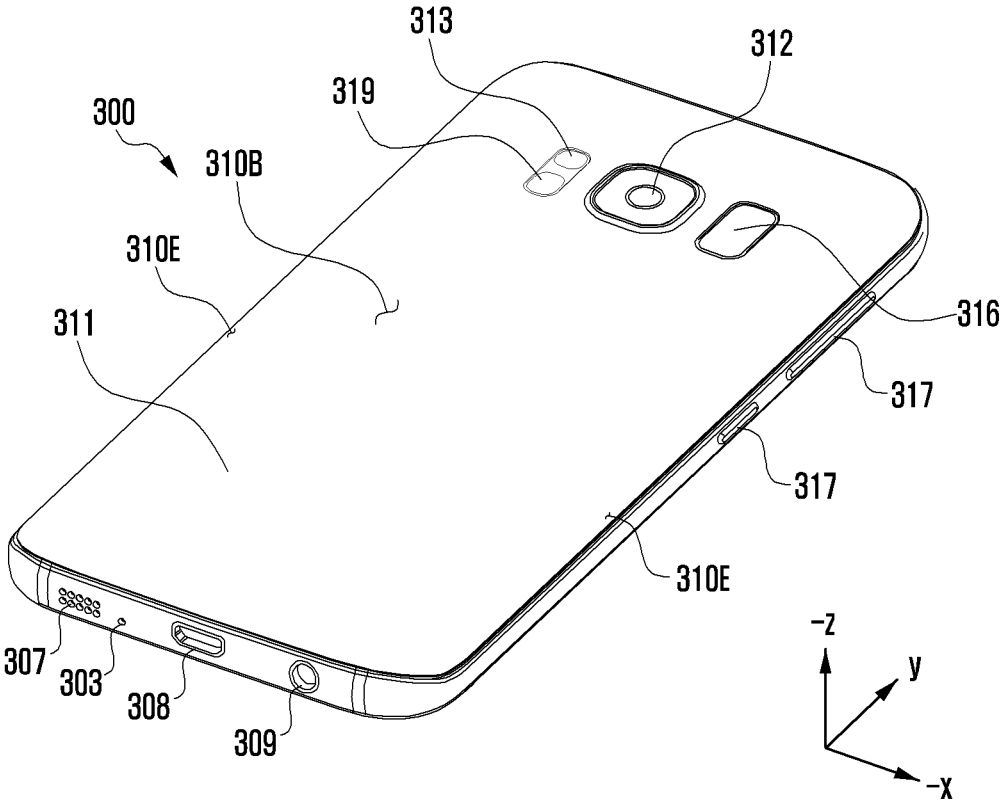
FIG. 3B is a perspective view showing a rear surface of the mobile electronic device shown in FIG. 3A according to an embodiment of the disclosure.

FIG. 3B is a rear perspective view illustrating a mobile electronic device 300 according to an embodiment of the disclosure.

Referring to FIGS. 3A and 3B, the mobile electronic device 300 includes a housing 310 including a first surface (or front surface) 310A, a second surface (or rear surface) 310B, and a side surface 310C enclosing a space between the first surface 310A and the second surface 310B. The housing may refer to a structure forming some of the first surface 310A, the second surface 310B, and the side surface 310C. The first surface 310A may be formed by an at least partially substantially transparent front plate 302 (e.g., a polymer plate or a glass plate including various coating layers). The second surface 310B may be formed by a substantially opaque rear plate 311. The rear plate 311 may be formed by coated or colored glass, ceramic, polymer, metal (e.g., aluminum, stainless steel (STS), or magnesium), or a combination of at least two of the above materials. The side surface 310C may be coupled to the front plate 302 and the rear plate 311 and be formed by a side bezel structure (or "side member") 318 including a metal and/or a polymer. The rear plate 311 and the side bezel structure 318 may be integrally formed and include the same metal material, such as aluminum.

The front plate 302 may include two first regions 310D bent and extended seamlessly from the first surface 310A toward the rear plate 311 at both ends of a long edge of the front plate 302. In FIG. 3B, the rear plate 311 may include two second regions 310E bent and extended seamlessly from the second surface 310B towards the front plate 302 at both ends of a long edge. The front plate 302 (or the rear plate 311) may include only one of the first regions 310D (or the second regions 310E). A portion of the first regions W the above embodiments, when viewed from the side surface of the mobile electronic device 300, the side bezel structure 318 may have a first thickness (or width) at a side surface in which the first region 310D or the second region 310E is not included and have a second thickness less than the first thickness at a side surface including the first region 310D or the second region 310E.

The mobile electronic device 300 may include at least one of a display 301, audio modules 303, 307, and 314 sensor modules 304, 316, and 319, camera modules 305, 312, and 313, a key input device 317, a light emitting element 306, and connector holes 308 and 309. The mobile electronic device 300 may omit at least one of the components or may further include other components.

The display 301 may be exposed through a substantial portion of the front plate 302. At least part of the display 301 may be exposed through the front plate 302 forming the first region 310D of the side surface 310C and the first surface 310A. An edge of the display 301 may be formed to be substantially the same as an adjacent outer edge shape of the front plate 302. In order to enlarge an area where the display 301 is exposed, a distance between an outer edge of the display 301 and an outer edge of the front plate 302 may be formed to be substantially the same.

A recess or an opening may be formed in a portion of a screen display area of the display 301, and at least one of the audio module 314 and the sensor module 304, the camera module 305, and the light emitting element 306 aligned with the recess or the opening may be included. At least one of the audio module 314, the sensor module 304, the camera module 305, the fingerprint sensor module 316, and the light emitting element 306 may be included at a rear surface of a screen display area of the display 301. The display 301 may be coupled to or disposed adjacent to a touch detection circuit, a pressure sensor capable of measuring intensity (pressure) of the touch, and/or a digitizer for detecting a stylus pen of a magnetic field method. At least part of the sensor modules 304 and 319 and/or at least part of the key input device 317 may be disposed in a first region 310D and/or a second region 310E.

The audio modules 303, 307, and 314 may include a microphone hole 303 and speaker holes 307 and 314. The microphone hole 303 may dispose a microphone for obtaining an external sound, and plurality of microphones may be disposed to detect a direction of a sound. The speaker holes 307 and 314 may include an external speaker hole 307 and a call receiver hole 314. The speaker holes 307 and 314 and the microphone hole 303 may be implemented into one hole, or the speaker may be included without the speaker holes 307 and 314 (e.g., piezo speaker).

The sensor modules 304, 316, and 319 may generate an electrical signal or a data value corresponding to an operating state inside the mobile electronic device 300 or an environment state outside the mobile electronic device 300. The sensor modules 304, 316, and 319 may include a first sensor module 304 (e.g., proximity sensor) and/or a second sensor module (e.g., fingerprint sensor), disposed at the first surface 310A of the housing 310, and/or a third sensor module 319 (e.g., a heart rate monitor (HRM) sensor) and/or a fourth sensor module 316 (e.g., fingerprint sensor), disposed at the second surface 310B of the housing 310. The fingerprint sensor may be disposed at the second surface 310B as well as the first surface 310A (e.g., the display 301) of the housing 310. The mobile electronic device 300 may further include at least one of a gesture sensor, gyro sensor, air pressure sensor, magnetic sensor, acceleration sensor, grip sensor, color sensor, IR sensor, biometric sensor, temperature sensor, humidity sensor, and illumination sensor 304.

The camera modules 305, 312, and 313 may include a first camera device 305 disposed at the first surface 310A of the mobile electronic device 300, a second camera device 312 disposed at the second surface 310B of the mobile electronic device 300, and/or a flash 313. The camera modules 305 and 312 may include one or a plurality of lenses, an image sensor, and/or an image signal processor. The flash 313 may include a light emitting diode or a xenon lamp. Two or more lenses (infrared camera, wide angle and telephoto lens) and image sensors may be disposed at one surface of the mobile electronic device 300.

The key input device 317 may be disposed at the side surface 310C of the housing 310. The mobile electronic device 300 may not include some or all of the above-described key input devices 317, and the key input device 317 that is not included may be implemented in other forms such as a soft key on the display 301. The key input device 317 may include a sensor module 316 disposed at the second surface 310B of the housing 310.

The light emitting element 306 may be disposed at the first surface 310A of the housing 310. The light emitting element 306 may provide status information of the mobile electronic device 300 in an optical form. In one embodiment, the light emitting element 306 may provide a light source interworking with an operation of the camera module 305. The light emitting element 306 may include a light emitting diode (LED), an IR LED, and a xenon lamp.

The connector ports 308 and 309 may include a first connector port 308 that may receive a USB connector for transmitting and receiving power and/or data to and from an external electronic device and/or a second connector hole (e.g., earphone jack) 309 that can receive a connector for transmitting and receiving audio signals to and from an external electronic device.

Figure 3C:
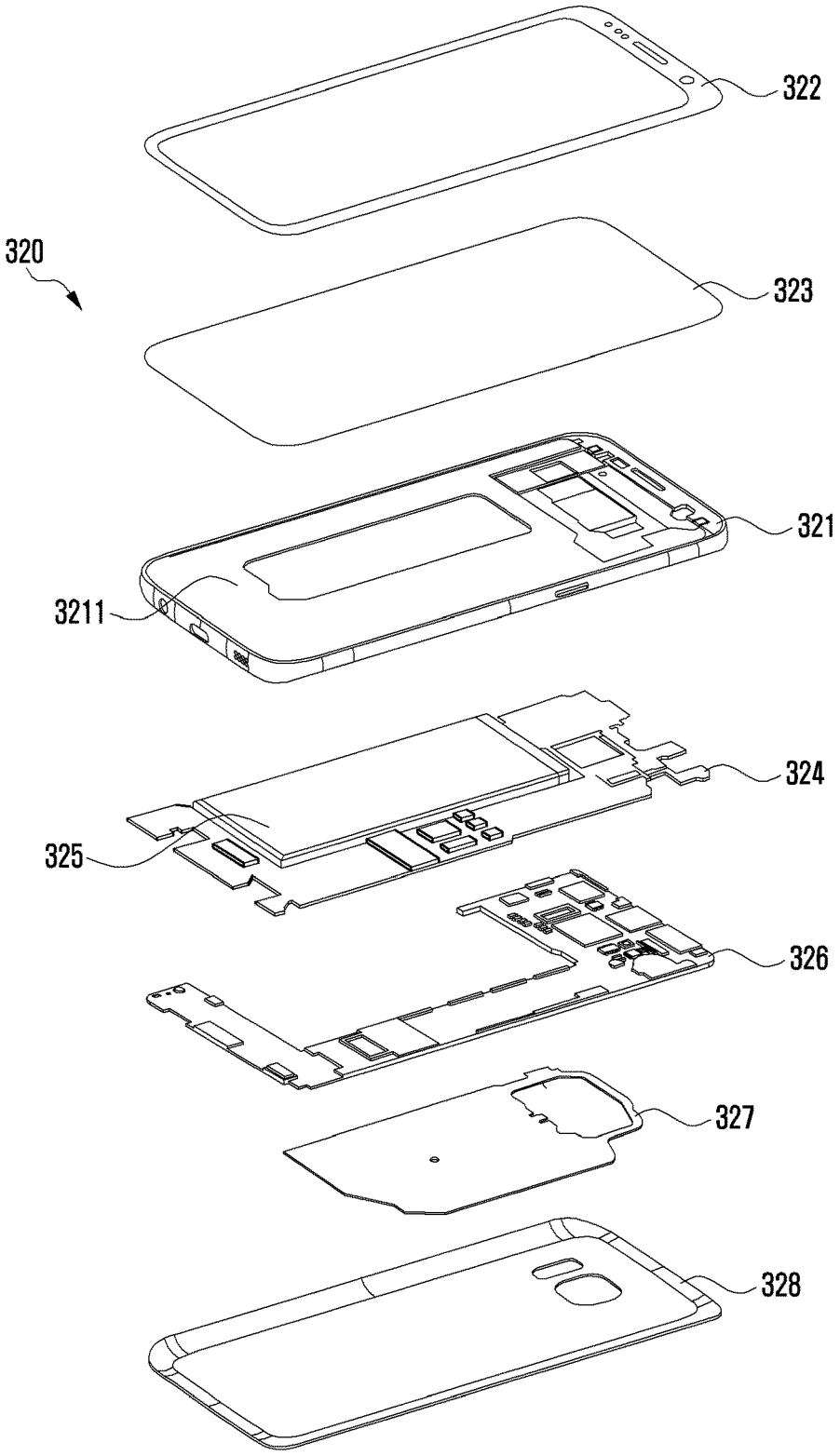
FIG. 3C is an exploded perspective view showing the mobile electronic device shown in FIGS. 3A and 3B according to an embodiment of the disclosure.

FIG. 3C is an exploded perspective view illustrating a mobile electronic device according to an embodiment of the disclosure.

Referring to FIG. 3C, the mobile electronic device 320 may include a side bezel structure 321, first support member 3211 (e.g., bracket), front plate 322, display 323, printed circuit board 324, battery 325, second support member 326 (e.g., rear case), antenna 327, and rear plate 328. The electronic device 320 may omit at least one of the components or may further include other components. At least one of the components of the electronic device 320 may be the same as or similar to at least one of the components of the mobile electronic device 300 of FIG. 3A or 3B and a duplicated description is omitted below.

The first support member 3211 may be disposed inside the electronic device 320 to be connected to the side bezel structure 321 or may be integrally formed with the side bezel structure 321. The first support member 3211 may be made of a metal material and/or a non-metal (e.g., polymer) material. The display 323 may be coupled to one surface of the first support member 3211, and the printed circuit board 324 may be coupled to an opposing surface of the first support member 3211. A processor, a memory, and/or an interface may be mounted in the printed circuit board 324. The processor may include one or more of a central processing unit, application processor, graphic processing unit, image signal processor, sensor hub processor, and communication processor.

The memory may include a volatile memory or a non-volatile memory.

The interface may include a HDMI, USB interface, SD card interface, and/or audio interface. The interface may electrically or physically connect the electronic device 320 to an external electronic device and include a USB connector, an SD card/multimedia card (MMC) connector, or an audio connector.

The battery 325 supplies power to at least one component of the electronic device 320 and may include a non-rechargeable primary battery, a rechargeable secondary battery, or a fuel cell. At least part of the battery 325 may be disposed on substantially the same plane as that of the printed circuit board 324. The battery 325 may be integrally disposed inside the electronic device 320 or may be detachably disposed in the electronic device 320.

The antenna 327 may be disposed between the rear plate 328 and the battery 325, and may include a near field communication (NFC) antenna, wireless charging antenna, and/or magnetic secure transmission (MST) antenna. The antenna 327 may perform short range communication with an external device or may wirelessly transmit and receive power required for charging. An antenna structure may be formed by some or a combination of the side bezel structure 321 and/or the first support member 3211.

Figure 4A:
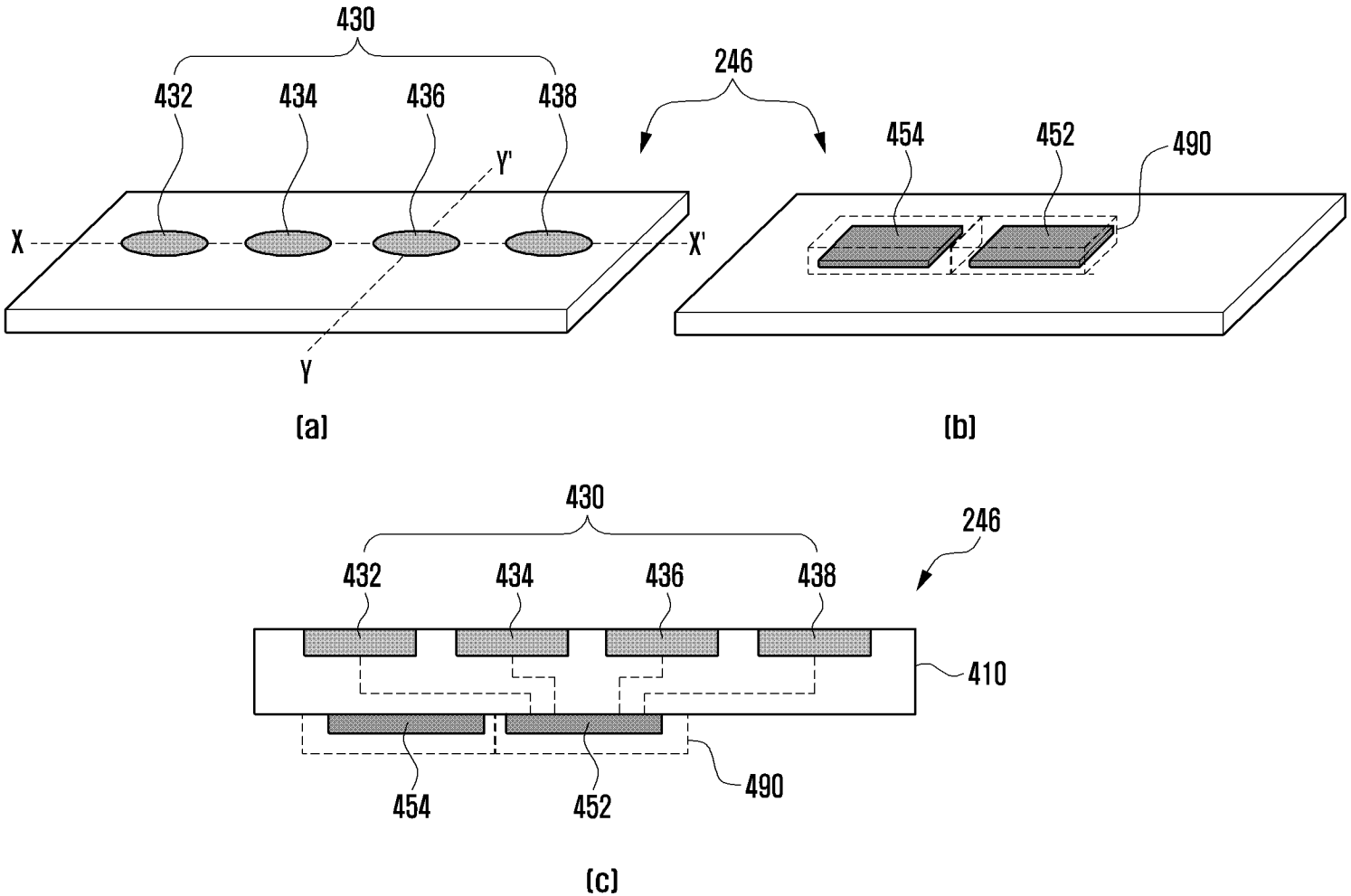
FIG. 4A show an embodiment of a structure of the third antenna module shown in and described with reference to FIG. 2 according to an embodiment of the disclosure.

FIG. 4A illustrates a structure of a third antenna module described with reference to FIG. 2 according to an embodiment of the disclosure.

FIG. 4A at (a) is a perspective view illustrating the third antenna module 246 viewed from one side, FIG. 4A at (b) is a perspective view illustrating the third antenna module 246 viewed from the other side, and FIG. 4A at (c) is a cross-sectional view illustrating the third antenna module 246 taken along line X-X' of FIG. 4A at 9*a*).

Referring to FIG. 4A, the third antenna module 246 includes a printed circuit board 410, an antenna array 430, a RFIC 452, and a PMIC 454. The third antenna module 246 further includes a shield member 490. At least one of the above-described components may be omitted or at least two of the components may be integrally formed.

The printed circuit board 410 may include a plurality of conductive layers and a plurality of non-conductive layers stacked alternately with the conductive layers. The printed circuit board 410 may provide electrical connections between the printed circuit board 410 and/or various electronic components disposed outside using wirings and conductive vias formed in the conductive layer.

The antenna array 430 includes a plurality of antenna elements 432, 434, 436, or 438 disposed to form a directional beam. The antenna elements 432, 434, 436, or 438 may be formed at a first surface of the printed circuit board 410. The antenna array 430 may be formed inside the printed circuit board 410. The antenna array 430 may include the same or a different shape or type of a plurality of antenna arrays (e.g., dipole antenna array and/or patch antenna array).

The RFIC 452 may be disposed at a second surface opposite to the first surface of the printed circuit board 410 spaced apart from the antenna array. The RFIC 452 is configured to process signals of a selected frequency band transmitted/received through the antenna array 430. Upon transmission, the RFIC 452 may convert a baseband signal obtained from a communication processor to an RF signal of a designated band. Upon reception, the RFIC 452 may convert an RF signal received through the antenna array 430 to a baseband signal and transfer the baseband signal to the communication processor.

Upon transmission, the RFIC 452 may up-convert an IF signal (e.g., about 9 GHz to about 11 GHz) obtained from an intermediate frequency integrate circuit (IFIC) to an RF signal of a selected band. Upon reception, the RFIC 452 may down-convert the RF signal obtained through the antenna array 430, convert the RF signal to an IF signal, and transfer the IF signal to the IFIC.

The PMIC 454 may be disposed in another partial area (e.g., the second surface) of the printed circuit board 410 spaced apart from the antenna array 430. The PMIC 454 may receive a voltage from a main PCB to provide power necessary for the RFIC 452 on the antenna module.

The shielding member 490 may be disposed at a portion (e.g., the second surface) of the printed circuit board 410 so as to electromagnetically shield at least one of the RFIC 452 or the PMIC 454. The shield member 490 may include a shield can.

Alternatively, the third antenna module 246 may be electrically connected to another printed circuit board (e.g., main circuit board) through a module interface. The module interface may include a connecting member a coaxial cable connector, board to board connector, interposer, or flexible PCB (FPCB). The RFIC 452 and/or the PMIC 454 of the antenna module may be electrically connected to the printed circuit board through the connection member.

Figure 4B:
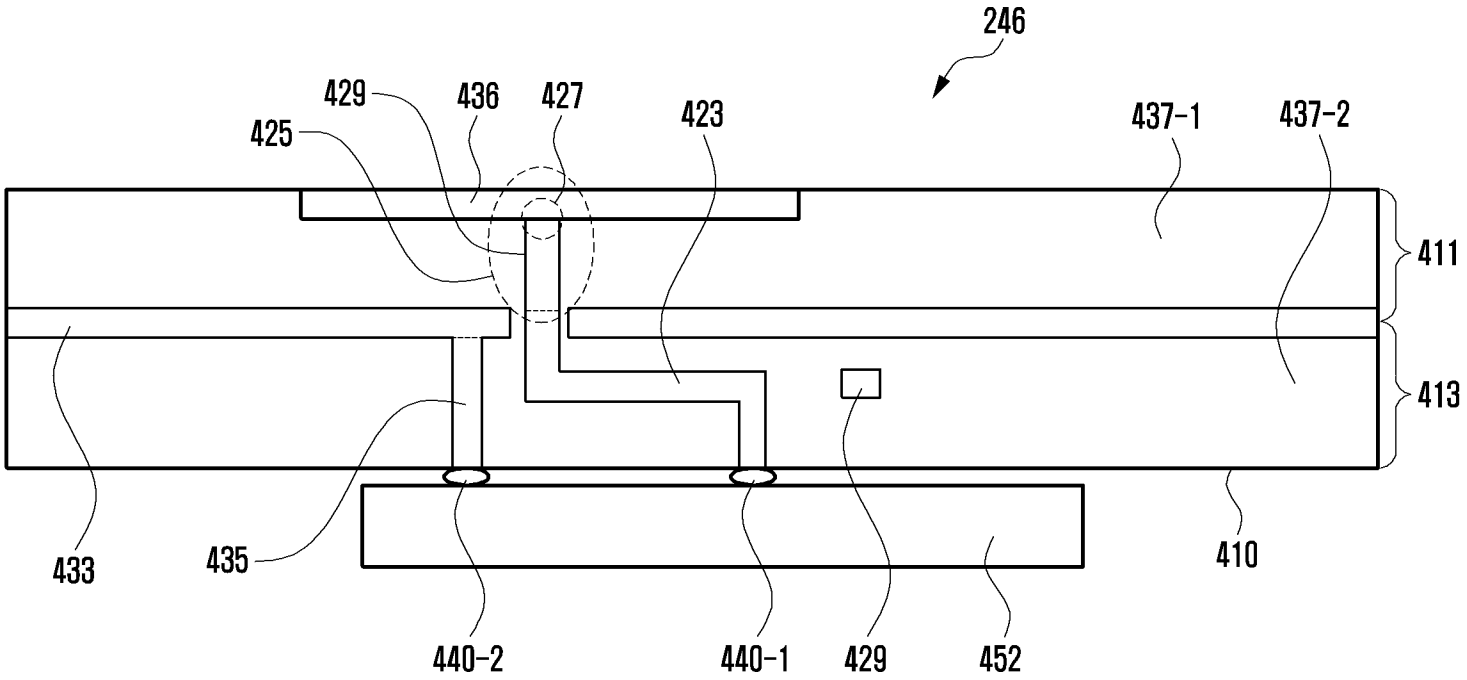
FIG. 4B is a cross-sectional view taken along the line Y-Y' in FIG. 4A according to an embodiment of the disclosure.

FIG. 4B is a cross-sectional view illustrating the third antenna module 246 taken along line Y-Y' of FIG. 4A at (a) according to an embodiment of the disclosure. The printed circuit board 410 of the illustrated embodiment may include an antenna layer 411 and a network layer 413.

Referring to FIG. 4B, the antenna layer 411 includes at least one dielectric layer 437-1, and an antenna element 436 and/or a power feeding portion 425 formed on or inside an outer surface of a dielectric layer. The power feeding portion 425 may include a power feeding point 427 and/or a power feeding line 429.

The network layer 413 includes at least one dielectric layer 437-2, at least one ground layer 433, at least one conductive via 435, a transmission line 423, and/or a power feeding line 429 formed on or inside an outer surface of the dielectric layer.

The RFIC 452 of FIG. 4A at (c) may be electrically connected to the network layer 413 through first and second solder bumps 440-1 and 440-2. Alternatively, various connection structures (e.g., solder or ball grid array (BGA)) instead of the solder bumps may be used. The RFIC 452 may be electrically connected to the antenna element 436 through the first solder bump 440-1, the transmission line 423, and the power feeding portion 425. The RFIC 452 may also be electrically connected to the ground layer 433 through the second solder bump 440-2 and the conductive via 435. The RFIC 452 may also be electrically connected to the above-described module interface through the power feeding line 429.

Figure 5A:
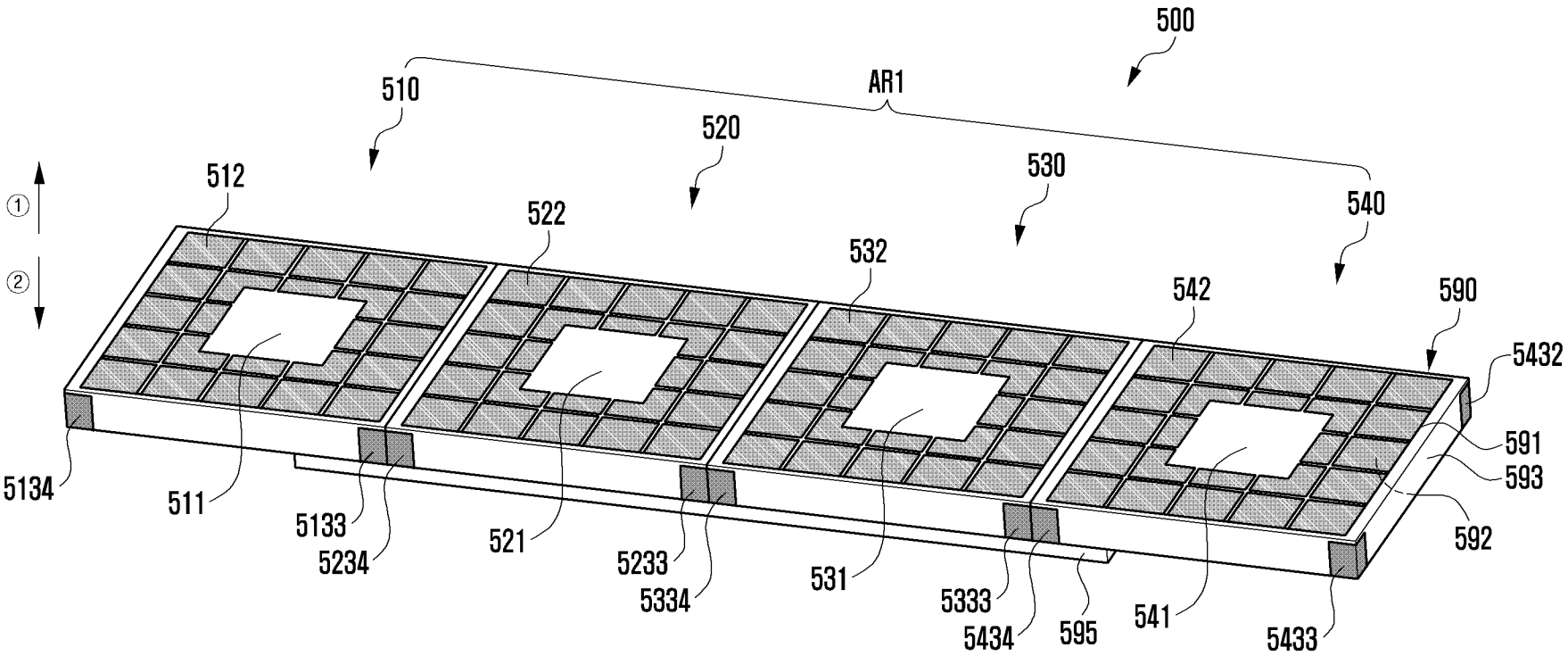
FIG. 5A is a perspective view showing an antenna module according to an embodiment of the disclosure.
Figure 5B:
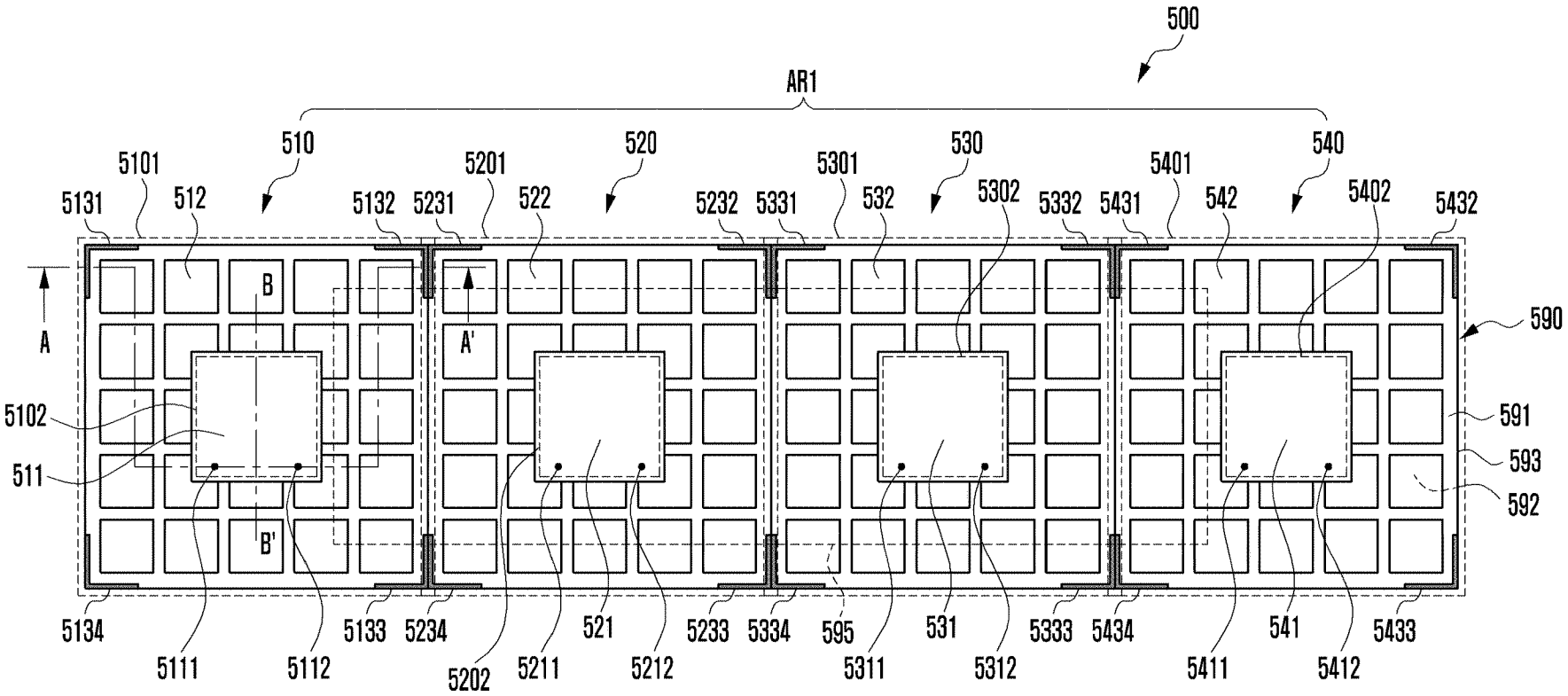
FIG. 5B is a plan view showing the antenna module shown in FIG. 5A according to an embodiment of the disclosure.

FIG. 5A is a perspective view showing an antenna module 500 according to an embodiment of the disclosure. FIG. 5B is a plan view showing the antenna module 500 shown in FIG. 5A according to an embodiment of the disclosure.

The antenna module 500 of FIGS. 5A and 5B may be similar, at least in part, to the third antenna module 246 of FIG. 2, or may include other embodiments of the antenna module.

Referring to FIGS. 5A and 5B, the antenna module 500 may include an antenna array AR1 composed of a plurality of antenna structures 510, 520, 530, and 540. According to an embodiment, the plurality of antenna structures 510, 520, 530, and 540 may be formed on a printed circuit board (PCB) 590. According to an embodiment, the PCB 590 may have a first surface 591 facing a first direction (indicated by ①, e.g., the −Z direction in FIG. 3B), a second surface 592 facing a direction (indicated by ②, e.g., the Z direction in FIG. 3A) opposite to the first surface 591, and a lateral surface 593 that surrounds a space between the first and second surfaces 591 and 592. According to an embodiment, the antenna module 500 may include a wireless communication circuit 595 disposed on the second surface 592 of the PCB 590. According to an embodiment, the plurality of antenna structures 510, 520, 530, and 540 may be electrically connected to the wireless communication circuit 595. According to an embodiment, the wireless communication circuit 595 may be configured to transmit and/or receive a radio frequency signal in the range of about 3 GHz to 100 GHz via the antenna array AR1.

According to various embodiments, the plurality of antenna structures 510, 520, 530, and 540 may include a first antenna structure 510, a second antenna structure 520, a third antenna structure 530, and a fourth antenna structure 540 which are disposed at regular intervals on the first surface 591 of the PCB 590. The antenna structures 510, 520, 530, 540 may have the substantially same configuration. Although the antenna module 500 according to an embodiment is illustrated and described as including the antenna array AR1 composed of four antenna structures 510, 520, 530, and 540, this is exemplary and should not be construed as a limitation. Alternatively, the antenna module 500 may include, as the antenna array AR1, one, two, three, five, or more antenna structures.

According to various embodiments, when viewed from above the first surface 591 of the PCB 590, the first antenna structure 510 may include a first area 5101 and a second area 5102 surrounded by the first area 5101. According to an embodiment, when viewed from above the first surface 591, the first antenna structure 510 may include a plurality of first conductive patches 512 periodically disposed in the first area 5101. According to an embodiment, when viewed from above the first surface 591, the first antenna structure 510 may include a second conductive patch 511 overlapped, at least in part, with the second area 5102. According to an embodiment, the first conductive patches 512 may be disposed to be capacitively coupled with the second conductive patch 511. According to an embodiment, when viewed from above the first surface 591, the first antenna structure 510 may include one or more conductive walls 5131, 5132, 5133, and 5134 formed along at least a portion of an outer periphery of the first area 5101. According to an embodiment, each of the conductive walls 5131, 5132, 5133, and 5134 may have one end electrically and physically connected to a ground layer (e.g., a ground layer 5903 of FIG. 6A) of the PCB 590, and the other end disposed at a position capable of being capacitively coupled with the first conductive patches 512. According to an embodiment, the second conductive patch 511 may be formed in a shape having a four-direction symmetry structure to realize a dual polarized antenna. For example, the second conductive patch 511 may be formed in a square, circular, or regular octagonal shape. According to an embodiment, the second conductive patch 511 may be electrically connected to the wireless communication circuit 595 through a pair of feeders 5111 and 5112. According to an embodiment, the pair of feeders 5111 and 5112 may include a first feeder 5111 and a second feeder 5112 which are symmetrically disposed with respect to a center line B-B' of the second conductive patch 511. Thus, the second conductive patch 511 may be formed as a dual polarized antenna. In another embodiment, the second conductive patch 511 may include feeders for dual polarization and dual feeding. In still another embodiment, the second conductive patch 511 may include only one feeder for single polarization. In this case, the second conductive patch 511 may not be formed in the symmetrical shape as described above.

According to various embodiments, when viewed from above the first surface 591, the first conductive patches 512 may be disposed to surround the second conductive patch 511 positioned in the center. According to an embodiment, the first conductive patches 512 may be exposed to the first surface 591 of the PCB 590 or disposed near the first surface 591 inside the PCB 590. According to an embodiment, in the PCB 590, the first conductive patches 512 may be disposed on an insulating layer different from a certain insulating layer on which the second conductive patch 511 is disposed. According to an embodiment, an insulating layer where the first conductive patches 512 is disposed may be closer to the first surface 591 than another insulating layer where the second conductive patch 511 is disposed. In another embodiment, the first conductive patches 512 and the second conductive patch 511 may be disposed side by side on the same insulating layer. In still another embodiment, an insulating layer where the first conductive patches 512 is disposed may be farther from the first surface 591 than another insulating layer where the second conductive patch 511 is disposed. According to an embodiment, when viewed from above the first surface 591, the first conductive patches 512 may be disposed side by side with the second conductive patch 511. In another embodiment, when viewed from above the first surface 591, the first conductive patches 512 may be disposed to be overlapped, at least in part, with the second conductive patch 511. In this case, the first conductive patches 512 and the second conductive patch 511 may be disposed on different insulating layers of the PCB 590. According to an embodiment, as shown, each of the first conductive patches 512 may be formed of a conductive plate having a rectangular shape. In another embodiment, each of the first conductive patches 512 may be formed in a circular shape, an elliptical shape, or any polygonal shape other than a rectangular shape. According to an embodiment, when the second conductive patch 511 is implemented as a dual polarized antenna, the overall shape formed by the first conductive patches 512 may have a four-direction symmetry structure.

According to various embodiments, the one or more conductive walls 5131, 5132, 5133, and 5134 may be disposed on the lateral surface 593 of the PCB 590. According to an embodiment, the conductive walls 5131, 5132, 5133, and 5134 may be disposed to be exposed or not to be exposed on the lateral surface 593 of the PCB 590. According to an embodiment, the conductive walls 5131, 5132, 5133, and 5134 may be disposed at regular intervals along the outer periphery of the first area 5101 in which the first conductive patches 512 of the PCB 590 are disposed. In another embodiment, the conductive walls 5131, 5132, 5133, and 5134 may be disposed at regular intervals in any area capable of being capacitively coupled with the first conductive patches 512 other than the lateral surface the PCB 590. According to an embodiment, when the second conductive patch 511 operates as a dual polarized antenna or a dual polarized, dual feed antenna, the conductive walls 5131, 5132, 5133, and 5134 may be disposed at regular intervals along the outer perimeter of the first conductive patches 512 so as to always have the same layout as the initial layout even after the first conductive patches 512 rotate by 90 degrees, 180 degrees, or 270 degrees. According to an embodiment, the conductive walls 5131, 5132, 5133, and 5134 may include a first conductive wall 5131, a second conductive wall 5132, a third conductive wall 5133, and a fourth conductive wall 5134 which are disposed on corners of the PCB 590 along the outer perimeter of the first conductive patches 512. As will be described below, the conductive walls 5131, 5132, 5133, and 5134 may be extended from the first surface 591 to the second surface 592 of the PCB 590. Also, one ends of the conductive walls may be electrically connected to a ground layer (e.g., a ground layer 5903 in FIG. 6A) disposed near the second surface 592 of the PCB 590, and the other ends may be disposed to be capacitively coupled with the first conductive patches 512.

According to various embodiments, each of the second antenna structure 520, the third antenna structure 530, and/or the fourth antenna structure 540 may have the substantially same configuration as that of the first antenna structure 510. According to an embodiment, when viewed from above the first surface 591, the second antenna structure 520 may include a third area 5201 and a fourth area 5202 surrounded by the third area 5201. According to an embodiment, when viewed from above the first surface 591, the second antenna structure 520 may include a plurality of third conductive patches 522 disposed in the third area 5201, and a fourth conductive patch 521 disposed to be overlapped, at least in part, with the fourth area 5202 and having a third feeder 5211 and/or a fourth feeder 5212. According to an embodiment, when viewed from above the first surface 591, the second antenna structure 520 may include one or more conductive walls 5231, 5232, 5233, and 5234 formed along at least a portion of an outer periphery of the third area 5201.

According to various embodiments, when viewed from above the first surface 591, the third antenna structure 530 may include a fifth area 5301 and a sixth area 5302 surrounded by the fifth area 5301. According to an embodiment, when viewed from above the first surface 591, the third antenna structure 530 may include a plurality of fifth conductive patches 532 disposed in the fifth area 5301, and a sixth conductive patch 531 disposed to be overlapped, at least in part, with the sixth area 5302 and having a fifth feeder 5311 and/or a sixth feeder 5312. According to an embodiment, when viewed from above the first surface 591, the third antenna structure 530 may include one or more conductive walls 5331, 5332, 5333, and 5334 formed along at least a portion of an outer periphery of the fifth area 5301.

According to various embodiments, when viewed from above the first surface 591, the fourth antenna structure 540 may include a seventh area 5401 and an eighth area 5402 surrounded by the seventh area 5401. According to an embodiment, when viewed from above the first surface 591, the fourth antenna structure 540 may include a plurality of seventh conductive patches 542 disposed in the seventh area 5401, and an eighth conductive patch 541 disposed to be overlapped, at least in part, with the eighth area 5402 and having a seventh feeder 5411 and/or an eighth feeder 5412. According to an embodiment, when viewed from above the first surface 591, the fourth antenna structure 540 may include one or more conductive walls 5431, 5432, 5433, and 5434 formed along at least a portion of an outer periphery of the seventh area 5401.

According to embodiments of the disclosure, the antenna module 500 forms indirect grounding with the ground layer (e.g., the ground layer 5903 in FIG. 6A) through the conductive walls 5131, 5132, 5133, 5134, 5231, 5232, 5233, 5234, 5331, 5332, 5333, 5334, 5431, 5432, 5433, and 5433 disposed to be capacitively coupled with the first conductive patches 512, the third conductive patches 522, the fifth conductive patches 532, or the seventh conductive patches 542, which are disposed respectively around the second conductive patch 511, the fourth conductive patch 521, the sixth conductive patch 531, or the eighth conductive patch 541. This may not only improve the isolation property in the operating frequency band, but also expand the bandwidth without reducing the radiation efficiency.

Figure 6A:
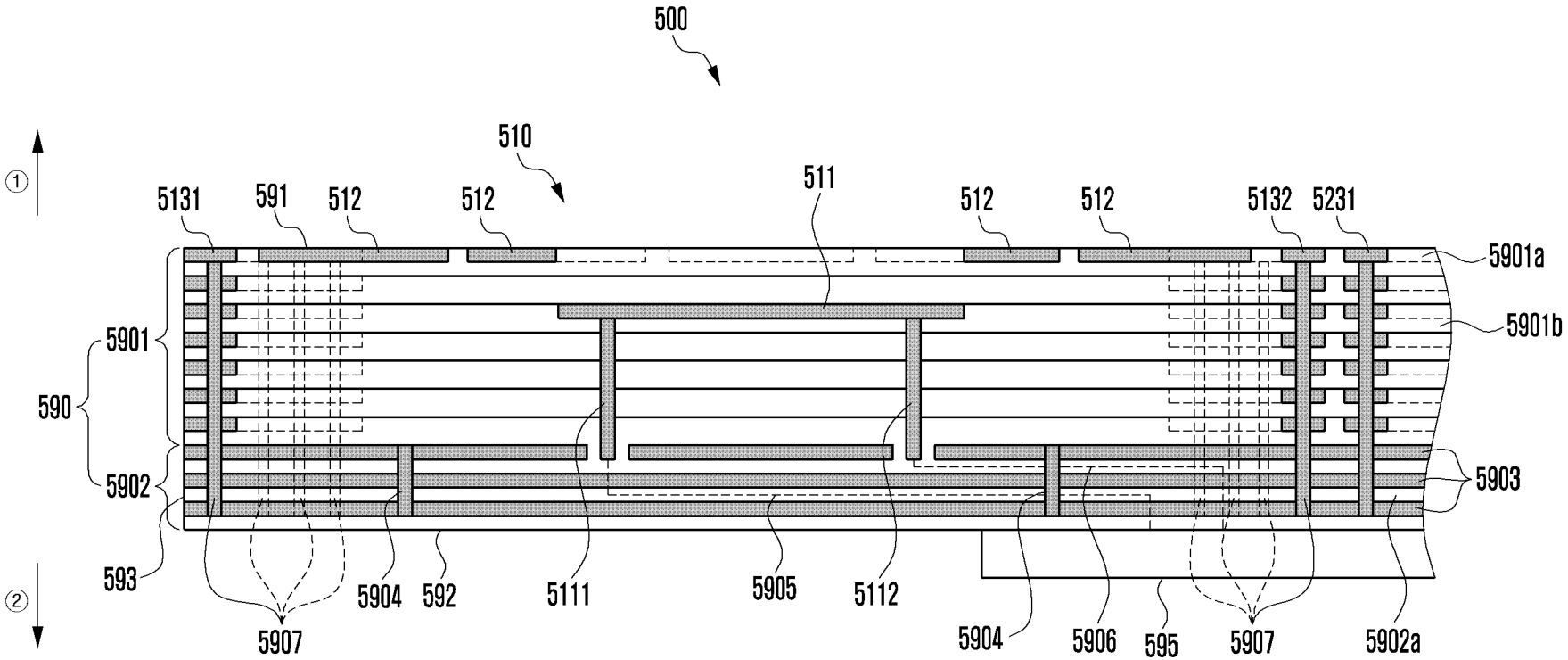
FIG. 6A is a cross-sectional view taken along the line A-A' in FIG. 5B according to an embodiment of the disclosure.

FIG. 6A is a cross-sectional view taken along the line A-A' in FIG. 5B according to an embodiment of the disclosure.

Although an arrangement configuration of the first antenna structure 510 disposed in the PCB 590 of the antenna module 500 is shown in FIG. 6A and will be described hereinafter, each of the second, third, and fourth antenna structures (e.g., 520, 530, and 540 in FIG. 5B) as well may have the substantially same arrangement configuration.

Referring to FIG. 6A, the antenna module 500 may include the first antenna structure 510. According to an embodiment, the first antenna structure 510 may include the PCB 590. According to an embodiment, the PCB 590 may have the first surface 591, the second surface 592 facing a direction opposite to the first surface 591, and the lateral surface 593 surrounding a space between the first and second surface 591 and 592. According to an embodiment, the PCB 590 may include a plurality of insulating layers. According to an embodiment, the PCB 590 may include a first layer region 5901 having at least one insulating layer, and a second layer region 5902 adjoining the first layer region 5901 and having another at least one insulating layer. According to an embodiment, the first layer region 5901 may include the first conductive patches 512 and the second conductive patch 511. According to an embodiment, the second layer region 5902 may include at least one ground layer 5903. According to an embodiment, a plurality of ground layers 5903 may be formed through a plurality of insulating layers in the second layer region 5902 and may operate as one ground layer through at least one conductive via 5904 vertically penetrating the respective ground layers.

According to various embodiments, the first antenna structure 510 may include the first conductive patches 512 disposed on a first insulating layer 5901*a* closer to the first surface 591 than the second surface 592 in the first layer region 5901.

According to various embodiments, the first antenna structure 510 may include the second conductive patch 511 disposed on a second insulating layer 5901*b* between the first insulating layer 5901*a* and the second surface 592 in the first layer region 5901. According to an embodiment, the second conductive patch 511 may be disposed close to the first surface 591 in the first layer region 5901. In another embodiment, the second conductive patch 511 may be disposed to be exposed to the first surface 591 in the first layer region 5901. According to an embodiment, when used as a dual polarized antenna, the first antenna structure 510 may include the first feeder 5111 and the second feeder 5112 electrically connected to different positions, spaced apart from each other, of the second conductive patch 511. According to an embodiment, each of the first and second feeders 5111 and 5112 may include a conductive via formed to penetrate the first layer region 5901 in a thickness direction of the PCB 590. According to an embodiment, the first feeder 5111 may be electrically connected to the wireless communication circuit 595 through a first feed line 5905 disposed in the second layer region 5902. According to an embodiment, the second feeder 5112 may be electrically connected to the wireless communication circuit 595 through a second feed line 5906 disposed in the second layer region 5902. According to an embodiment, the first feed line 5905 and/or the second feed line 5906 may be electrically isolated from the ground layer 5903 disposed in a third insulating layer 5902*a* in the second layer region 5902.

According to various embodiments, the first conductive patches 512 may be disposed closer to the first surface 591 than the second conductive patch 511 is. According to an embodiment, when viewed from above the first surface 591, the first conductive patches 512 may be disposed so as not to be overlapped with the second conductive patch 511. In another embodiment, when viewed from above the first surface 591, the first conductive patches 512 may be overlapped, at least in part, with the second conductive patch 511 while being disposed on an insulating layer different from an insulating layer where the second conductive patch 511 is disposed.

According to various embodiments, the first antenna structure 510 may include a plurality of conductive walls

5131 and 5132 disposed in the first layer region 5901 and extended from the first surface 591 to the second surface 592. According to an embodiment, each of the conductive walls 5131 and 5132 may be disposed around the first conductive patches 512 at a position that can be capacitively coupled with the first conductive patches 512. According to an embodiment, the conductive walls 5131 and 5132 may be formed through conductive vias 5907 that are electrically connected to and penetrate a plurality of conductive members disposed on adjacent insulating layers in the first layer region 5901. According to an embodiment, one end of each of the conductive walls 5131 and 5132, adjacent to the first conductive patches 512, may be disposed to be capacitively coupled with the first conductive patches 512. According to an embodiment, one end of each of the conductive walls 5131 and 5132, adjacent to the second surface 592, may be disposed to be electrically connected to at least one ground layer 5903 disposed on the third insulating layer in the second layer region 5902. Thus, the first conductive patches 512 may be indirectly grounded to the ground layer 5903, at least in part, through the conductive walls 5131 and 5132.

Figure 6B:
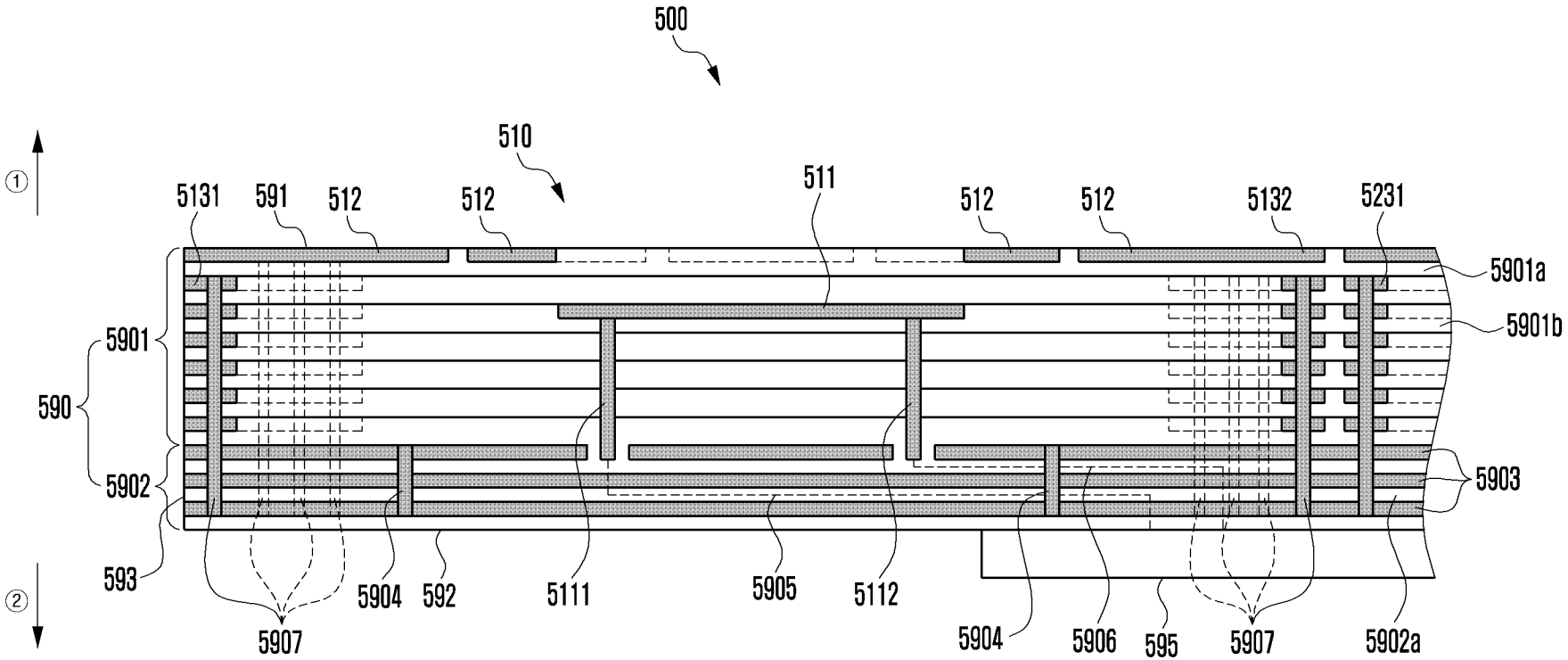
FIG. 6B is a cross-sectional view partially showing an antenna module according to an embodiment of the disclosure.

FIG. 6B is a cross-sectional view partially showing an antenna module 500 according to an embodiment of the disclosure.

The antenna module 500 shown in FIG. 6B has the substantially same configuration as that of the above-described antenna module 500 shown in FIG. 6A, so that a detailed description will be omitted.

Referring to FIG. 6A described above, the conductive walls 5131 and 5132 are disposed side by side with the first conductive patches 512 on the first insulating layer 5901*a* in the first layer region 5901 of the PCB 590. In contrast, the conductive walls 5131 and 5132 shown in FIG. 6B may be disposed to be lower than the first conductive patches 512. In this case, when viewed from above the first surface 591, at least parts of the conductive walls 5131 and 5132 may be disposed to be overlapped with the first conductive patches 512. In another embodiment, when viewed from above the first surface 591, the conductive walls 5131 and 5132 may be disposed so as not to be overlapped with the first conductive patches 512. That is, once being at a position capable of being capacitively coupled with the first conductive patches 512, the conductive walls 5131 and 5132 may be disposed on the same insulating layer (e.g., the first insulating layer 5901*a*) as the first conductive patches 512 is, or may be disposed on another insulating layer so as to be overlapped or not to be overlapped with the first conductive patches 512.

Figure 7:
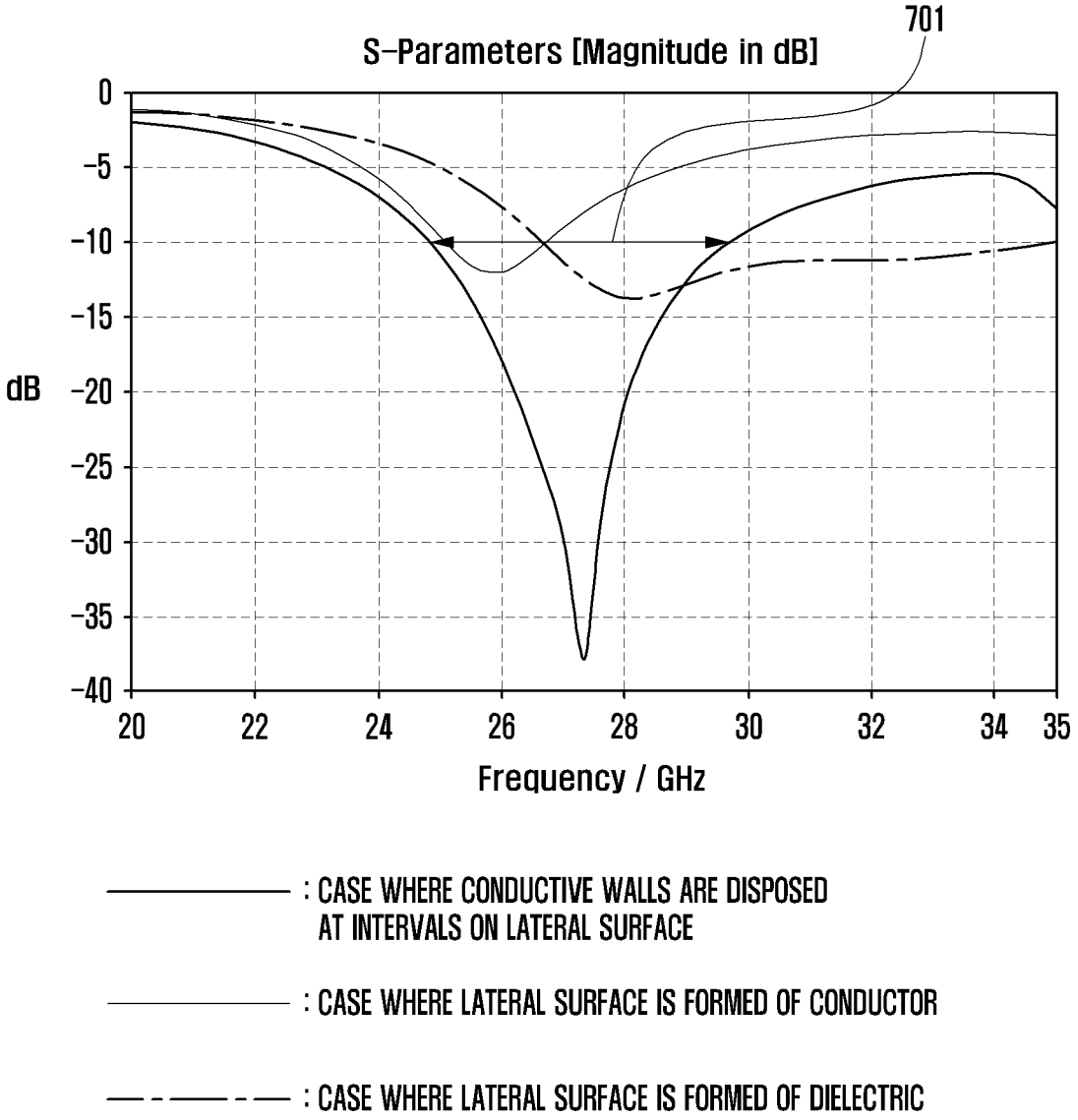
FIG. 7 is a graph comparing a return loss of an antenna module according to an embodiment of the disclosure.

FIG. 7 is a graph comparing a return loss of an antenna module 500 according to an embodiment of the disclosure.

Referring to FIG. 7, it can be seen that the antenna module (e.g., 500 in FIG. 5B) including the plurality of conductive walls (e.g., 5131, 5132, 5133, 5134, 5231, 5232, 5233, 5234, 5331, 5332, 5333, 5334, 5431, 5432, 5433, and 5433 in FIG. 5B) disposed, at least in part, around the first conductive patches, the third conductive patches, the fifth conductive patches, or the seventh conductive patches (e.g., 511, 521, 531, or 541 in FIG. 5B) has a bandwidth 701 of about 5 GHz, which is relatively wider than in case where the entire lateral surface is formed of a conductor or in case where the lateral surface is formed of only a dielectric without a conductor.

FIGS. 8A, 8B, 9A, and 9B are diagrams illustrating an impedance characteristic and current distribution for a frequency of an antenna module 500 according to various embodiments of the disclosure.

Figure 8A:
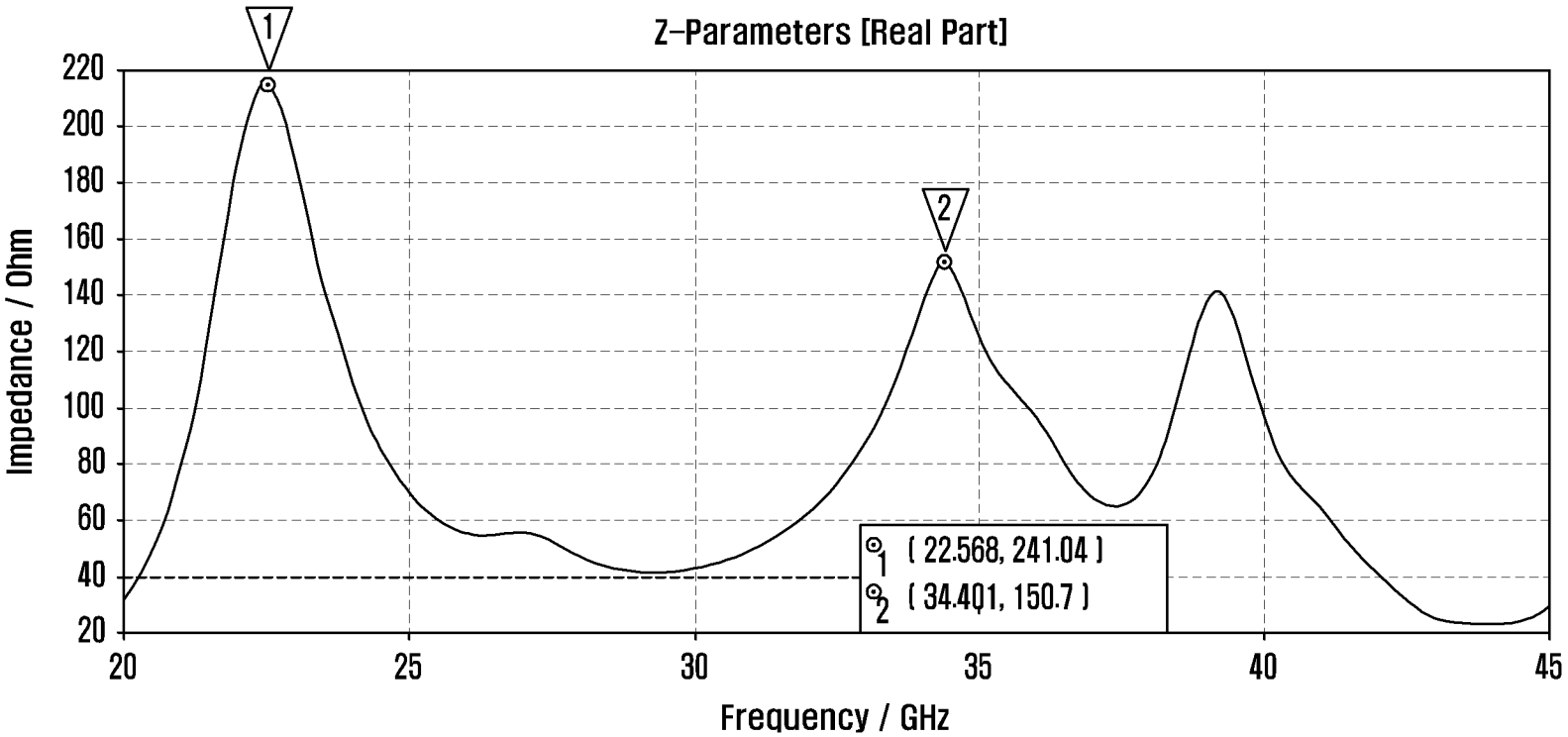
FIGS. 8A, 8B, 9A, and 9B are diagrams illustrating an impedance characteristic and current distribution for a frequency of an antenna module according to various embodiments of the disclosure.
Figure 8B:
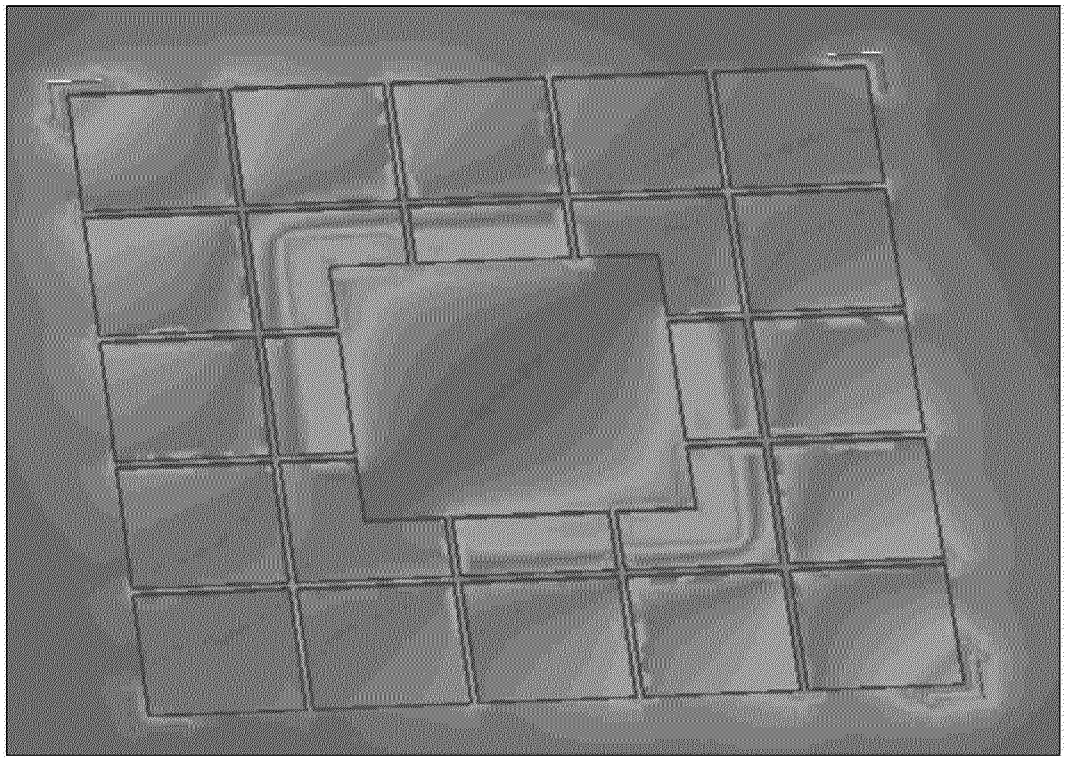

Referring to FIGS. 8A and 8B, it can be seen that, in a relatively low first frequency band (e.g., about 22.5 GHz band) ranging from about 22 GHz to about 25 GHz among the operating frequency band, the antenna module (e.g., 500 in FIG. 5B) has an electric field distribution that is symmetrical around the center of the second conductive patch (e.g., 511 in FIG. 5B) as in a general patch antenna.

Figure 9A:
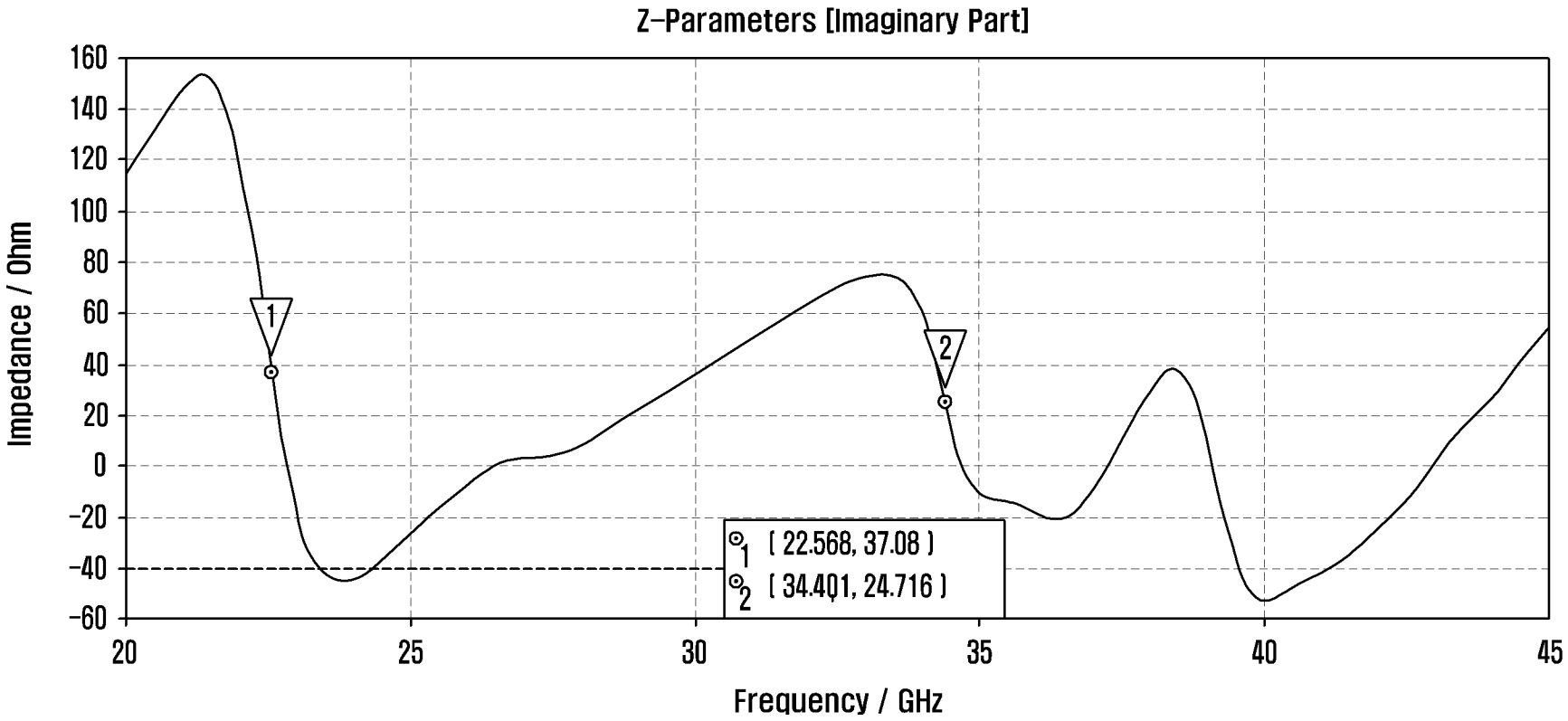
Figure 9B:
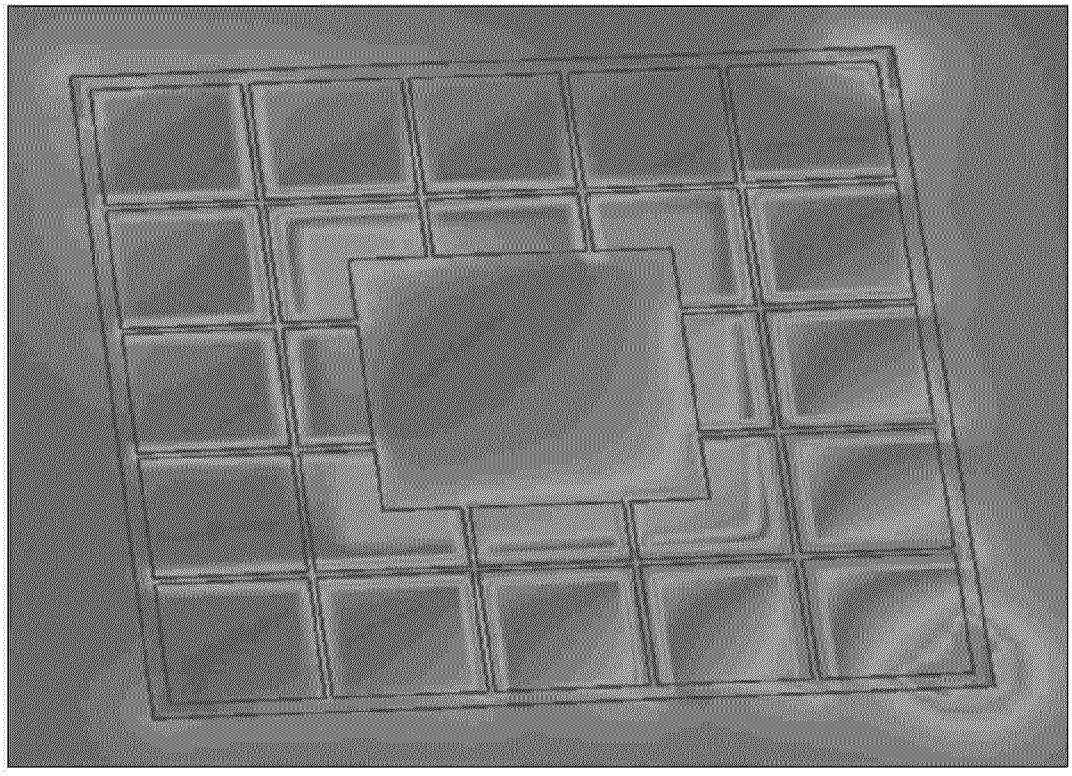

Referring to FIGS. 9A and 9B, it can be seen that, in a relatively high second frequency band (e.g., about 34 GHz band) ranging from about 29 GHz to about 35 GHz among the operating frequency band, the antenna module (e.g., 500 in FIG. 5B) has an electric field distribution that is relatively biased toward the conductive wall (e.g., 5133 in FIG. 5B) located at the outer periphery of the PCB (e.g., 590 in FIG. 5B) according as a frequency increases. For example, in the second frequency band, the antenna module (e.g., 500 in FIG. 5B) may have an electric field distribution similar to that of a planar inverted patch antenna (PIPA) through an indirect grounding structure formed between the conductive wall (e.g., 5133 in FIG. 5B) and the first conductive patches (e.g., 512 in FIG. 5B) disposed periodically. Therefore, the antenna module (e.g., 500 in FIG. 5B) may have two resonance modes in the operating frequency band, thereby having a wide resonance characteristic.

Figure 10:
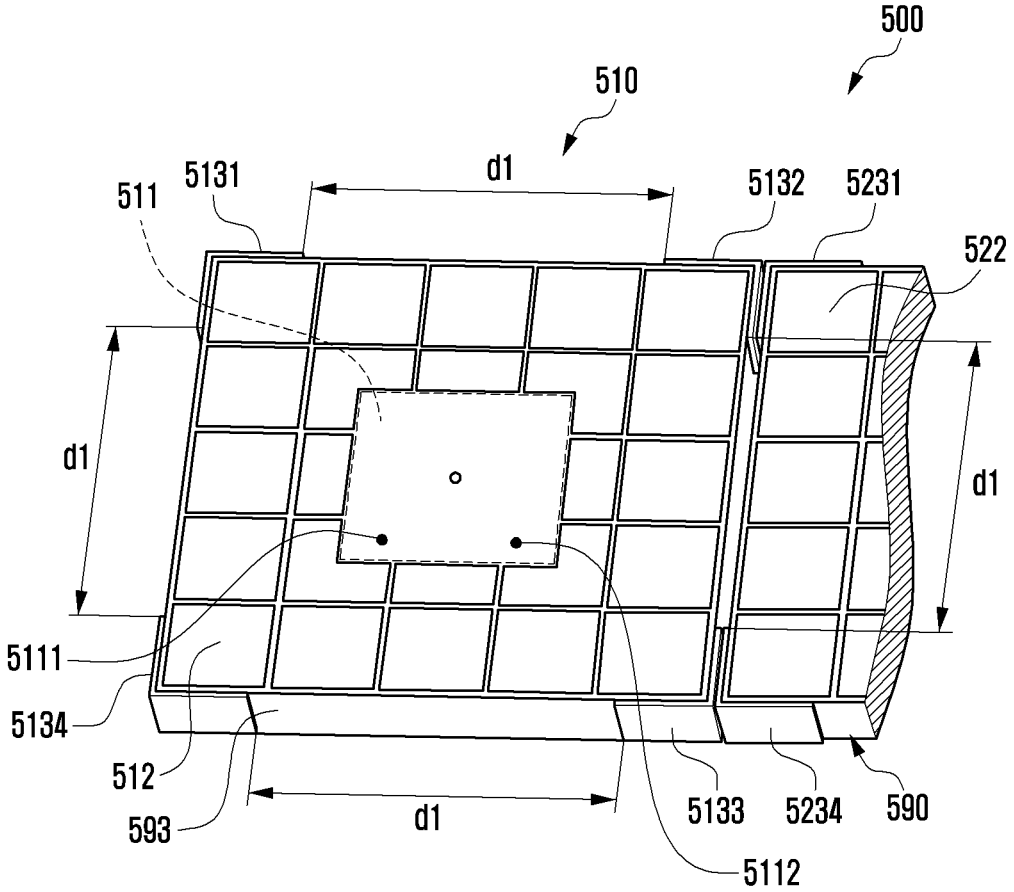
FIG. 10 is a perspective view partially showing an antenna module according to an embodiment of the disclosure.
Figure 11:
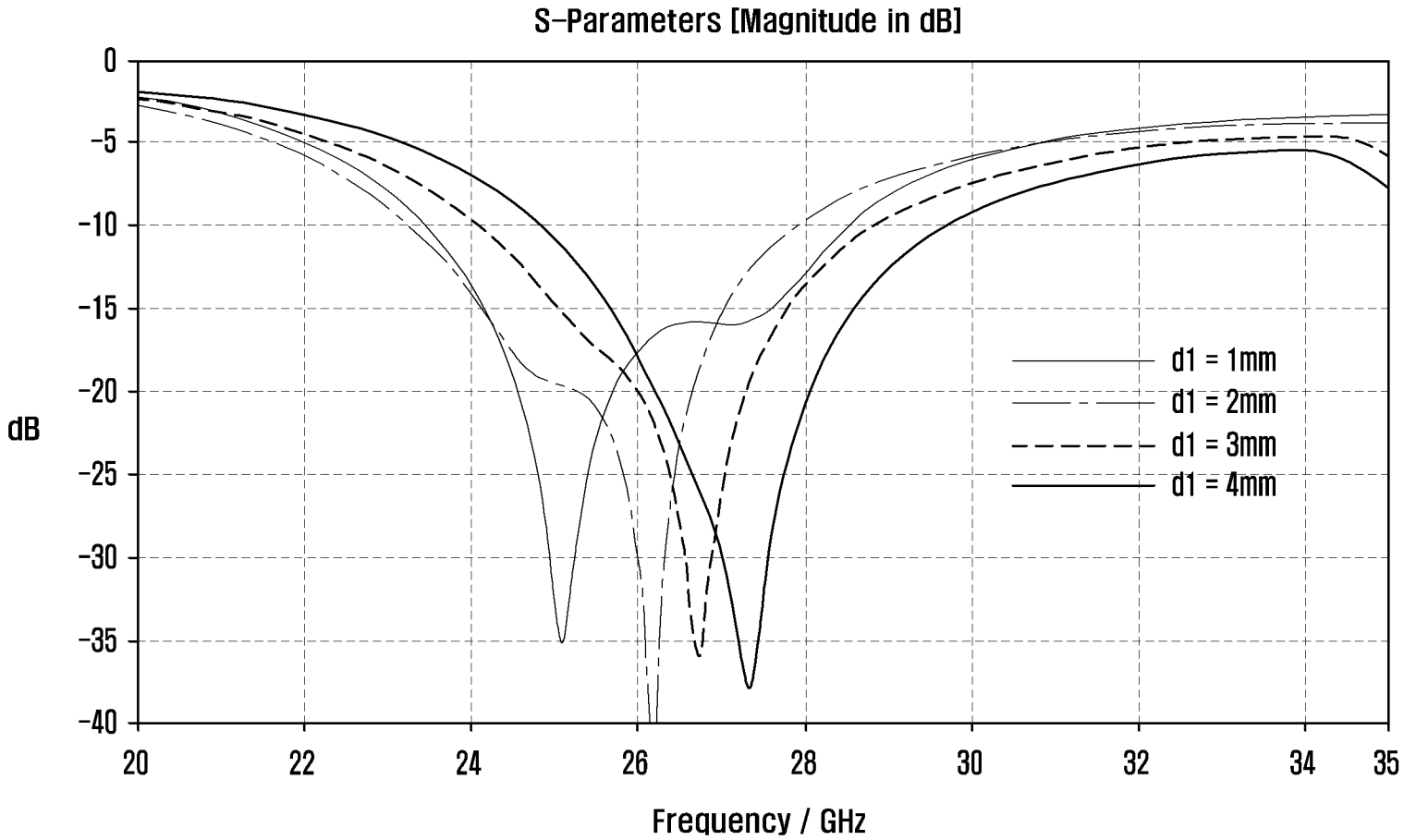
FIG. 11 is a graph showing a frequency characteristic with a change in distance between conductive walls shown in FIG. 10 according to an embodiment of the disclosure.

FIG. 10 is a perspective view partially showing an antenna module according to an embodiment of the disclosure. FIG. 11 is a graph showing a frequency characteristic with a change in distance between conductive walls shown in FIG. 10 according to an embodiment of the disclosure.

The antenna module 500 shown in FIG. 10 may have the substantially same configuration as that of the above-described antenna module 500 shown in FIGS. 5A and 5B, so that a detailed description will be omitted.

Referring to FIG. 10, the antenna module 500 may include the first conductive patches 512 disposed on the PCB 590, and the second conductive patch 511 disposed to be surrounded by the first conductive patches 512. In addition, the antenna module 500 may include the first conductive wall 5131, the second conductive wall 5152, the third conductive wall 5133, and/or the fourth conductive wall 5134, which may be disposed, at least in part, along the outer perimeter of the first conductive patches 512. According to an embodiment, the first to fourth conductive walls 5131, 5132, 5133, and 5134 are disposed at regular intervals along the outer perimeter of the first conductive patches 512 so as to have the same layout as the initial layout even after the antenna structure 510 rotates by 90 degrees, 180 degrees, or 270 degrees.

According to various embodiments, the antenna module 500 may secure a wide operating frequency band through the first conductive patches 512 disposed proximately from and capacitively coupled with the second conductive patch 511 and through the first to fourth conductive walls 5131, 5132, 5133, and 5134 disposed around the first conductive patches 512. According to an embodiment, in the antenna module 500, adjusting a distance (d1) between one conductive wall (e.g., the first conductive wall 5131 in FIG. 10) and an adjacent conductive wall (e.g., the second conductive wall 5132 or the fourth conductive wall 5134 in FIG. 10) may shift the operating frequency band with a wide bandwidth secured.

Referring to FIG. 11, as the distance (d1) between the first to fourth conductive walls 5131, 5132, 5133, and 5134 increases, that is, as the amount of coupling between the first conductive patches 512 and the conductive walls 5131, 5132, 5133, and 5134 decreases, the capacitance decreases, and thus the operating frequency band of the antenna module 500 is shifted to a higher frequency band.

The antenna module 500 according to embodiments may affect a frequency design because the operating frequency band is determined by adjusting the distance (d1) between the first to fourth conductive walls 5131, 5132, 5133, and 5134.

FIGS. 12A to 12E are diagrams illustrating a configuration of antenna modules 1200-1, 1200-2, 1200-3, 1200-4, and 1200-5 according to various embodiments of the disclosure. FIGS. 12A to 12E illustrate antenna modules each of which has a configuration for a dual polarization and feeding.

The antenna modules 1200-1, 1200-2, 1200-3, 1200-4, and 1200-5 shown in FIGS. 12A to 12E may be similar, at least in part, to the third antenna module 246 of FIG. 2, or may include other embodiments of the antenna module.

In FIGS. 12A to 12E, the first conductive patches (e.g., 512 in FIG. 10) are omitted from first conductive patch arrangement areas 1212, 1232, and 1252 to simplify illustration.

Figure 12A:
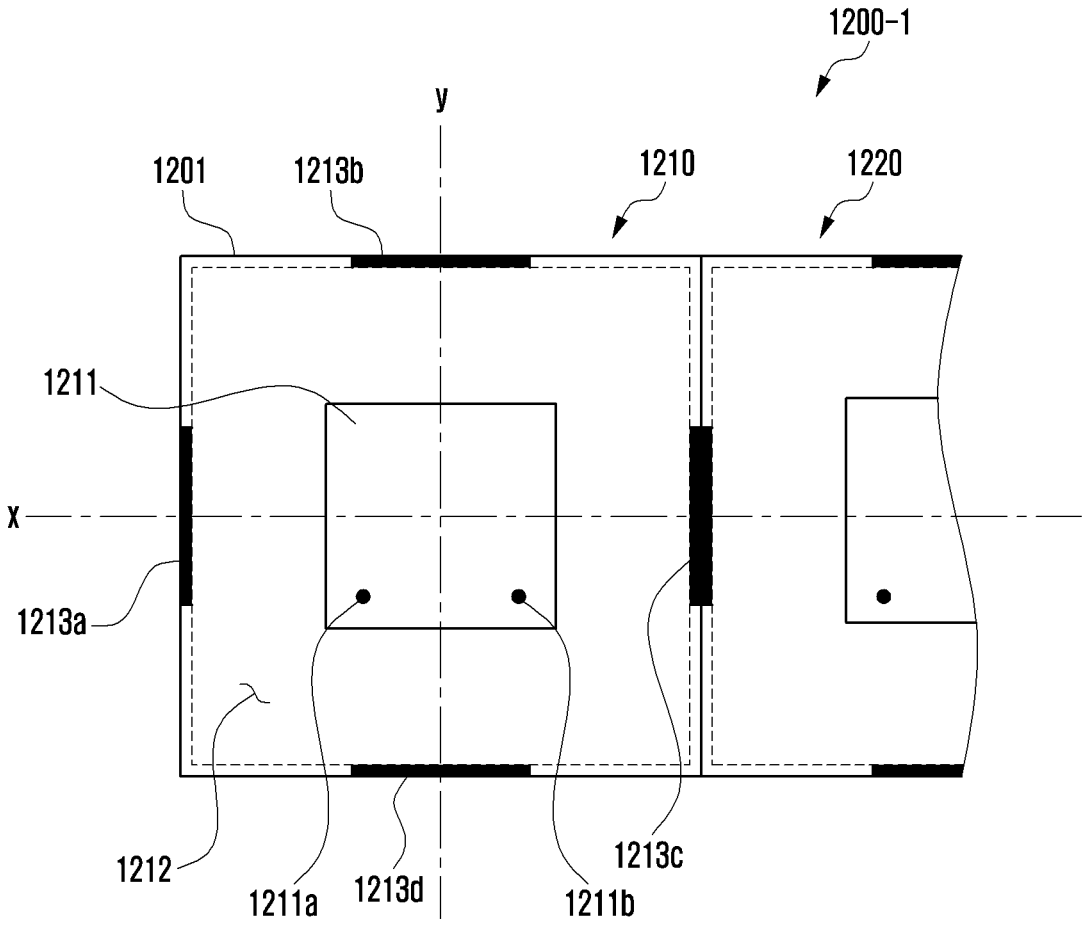
FIGS. 12A, 12B, 12C, 12D, and 12E are diagrams illustrating a configuration of antenna modules according to various embodiments of the disclosure.

Referring to FIG. 12A, the antenna module 1200-1 may include a first antenna structure 1210, a second antenna structure 1220, . . . , and an $N^{th}$ antenna structure, which are disposed at regular intervals on a printed circuit board (PCB) 1201. According to an embodiment, the antenna module 1200-1 may include N antenna structures disposed on one PCB 1201, and such antenna structures may have the substantially same configuration.

According to various embodiments, the first antenna structure 1210 may include a first conductive patch arrangement area 1212, a second conductive patch 1211, and first to fourth conductive walls 1213*a*, 1213*b*, 1213*c*, and 1213*d*. The first conductive patch arrangement area 1212 has the same layout as the initial layout even after rotating by 90 degrees, 180 degrees, or 270 degrees about an intersection between an x-axis and a y-axis perpendicular to each other. The second conductive patch 1211 is surrounded by the first conductive patch arrangement area 1212 and may include a first feeder 1211*a* and a second feeder 1211*b* which are disposed at symmetrical positions with respect to the y-axis. The first to fourth conductive walls 1213*a*, 1213*b*, 1213*c*, and 1213*d* are disposed at least in part along the outer periphery of the first conductive patch arrangement area 1212. According to an embodiment, the first to fourth conductive walls 1213*a*, 1213*b*, 1213*c*, and 1213*d* may also have the same layout as the initial layout even after rotating by 90 degrees, 180 degrees, or 270 degrees about the aforementioned intersection.

According to various embodiments, each of the first to fourth conductive walls 1213*a*, 1213*b*, 1213*c*, and 1213*d* may be disposed at each central portion of four edges along the outer periphery of the first conductive patch arrangement area 1212 having a square shape, and also arranged symmetrically with each other.

Figure 12B:
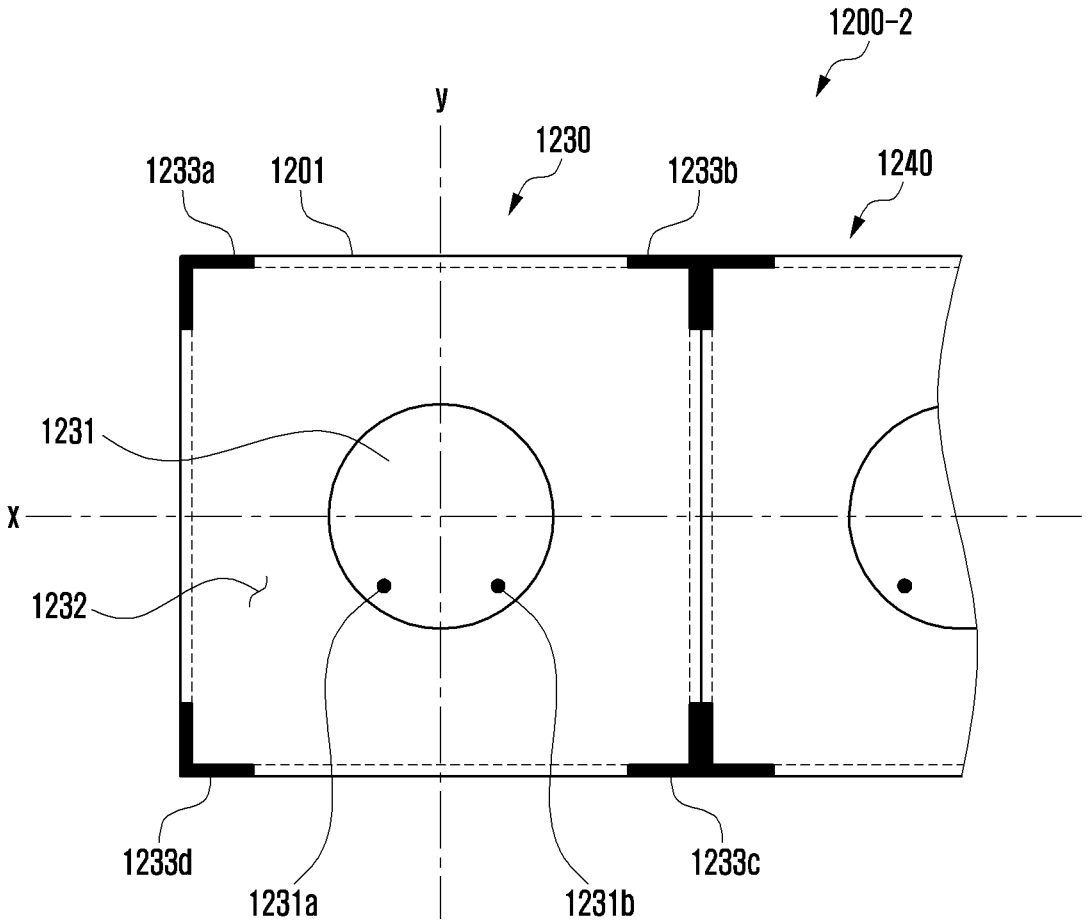
Figure 12C:
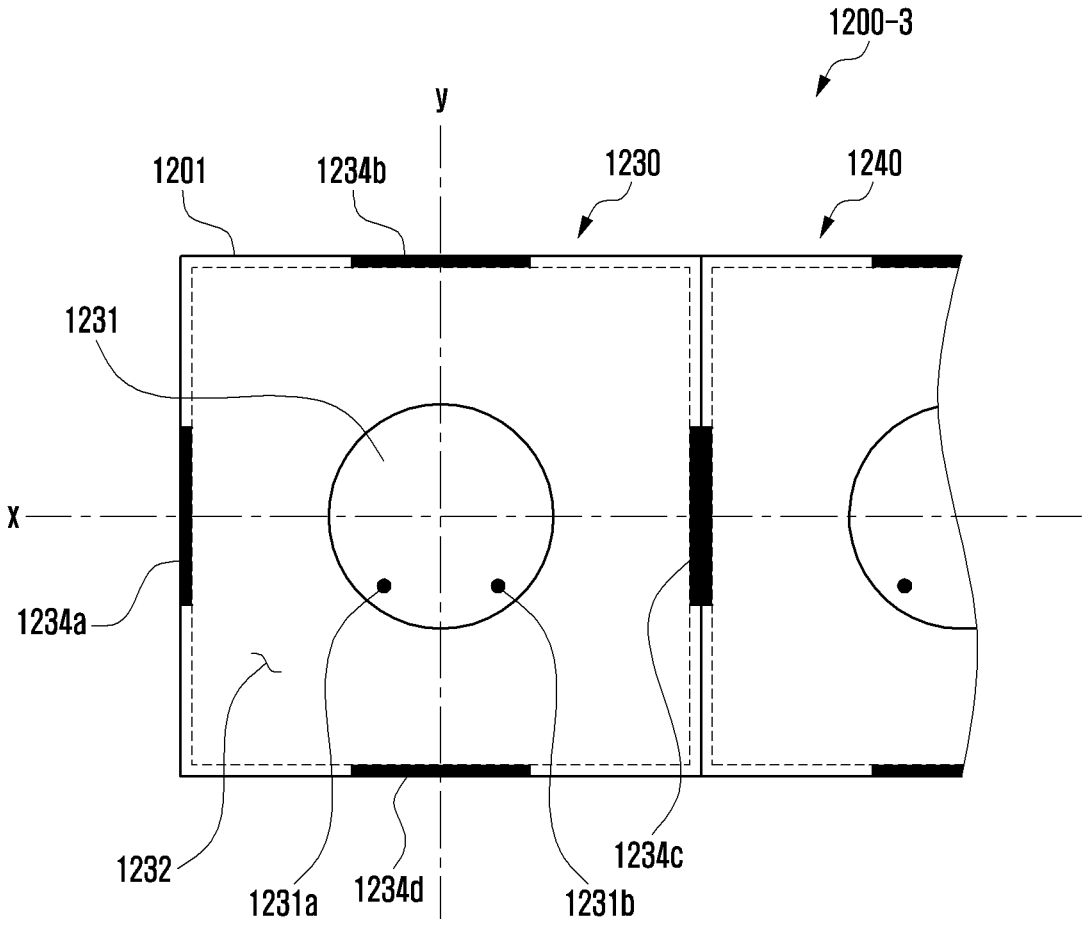

Referring to FIGS. 12B and 12C, each of the antenna modules 1200-2 and 1200-3 may include a first antenna structure 1230, a second antenna structure 1240, . . . , and an $N^{th}$ antenna structure, which are disposed at regular intervals on the PCB 1201. According to an embodiment, each of the antenna modules 1200-2 and 1200-3 may include N antenna structures disposed on one PCB 1201, and such antenna structures may have the substantially same configuration.

According to various embodiments, each of the antenna modules 1200-2 and 1200-3 may include a first conductive patch arrangement area 1232 disposed on the PCB 1201 in the same manner as in FIG. 12A, and a second conductive patch 1231 having a circular shape and surrounded by the first conductive patch arrangement area 1232. The second conductive patch 1231 may include a first feeder 1231*a* and a second feeder 1231*b*.

As shown in FIG. 12B, the antenna module 1200-2 may include first to fourth conductive walls 1233*a*, 1233*b*, 1233*c*, and 1233*d* disposed at each corner portion along the outer periphery of the first conductive patch arrangement area 1232 having a square shape.

As shown in FIG. 12C, the antenna module 1200-3 may include first to fourth conductive walls 1234*a*, 1234*b*, 1234*c*, and 1234*d* disposed at each central portion of four edges along the outer periphery of the first conductive patch arrangement area 1232 having a square shape.

Figure 12D:
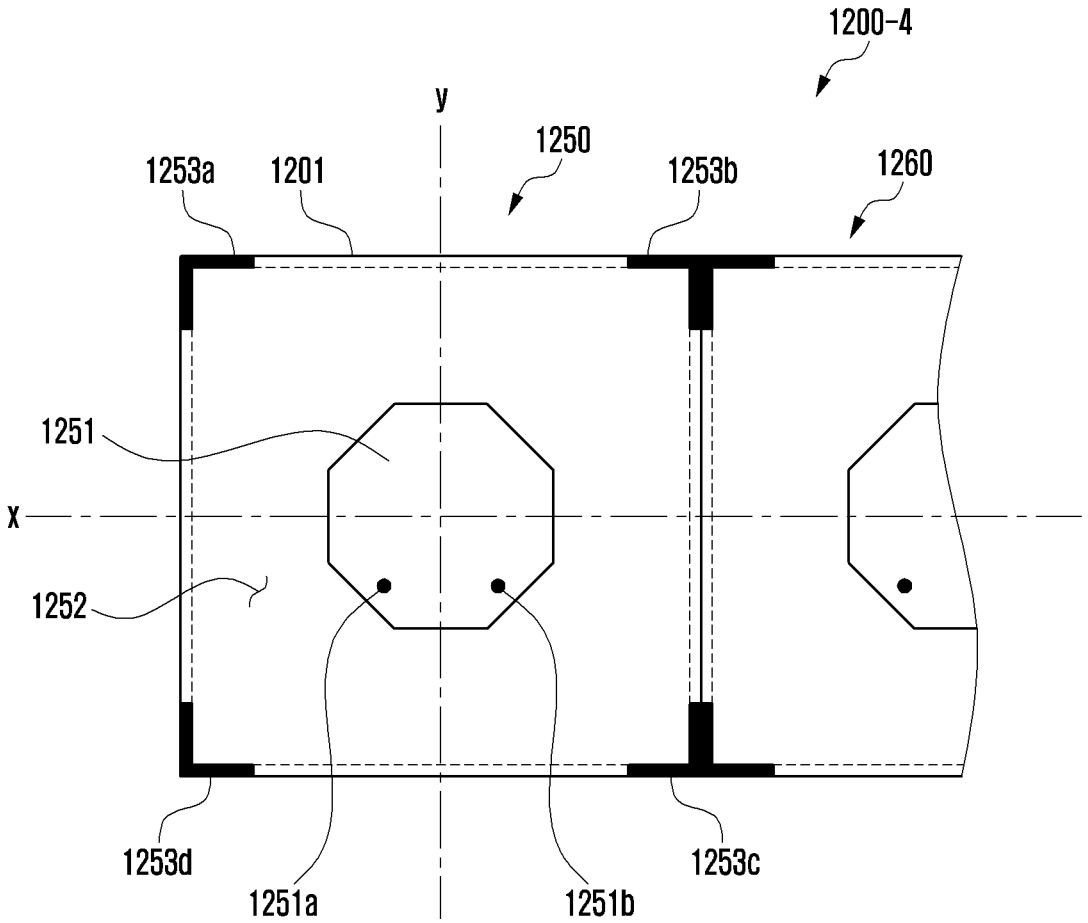
Figure 12E:
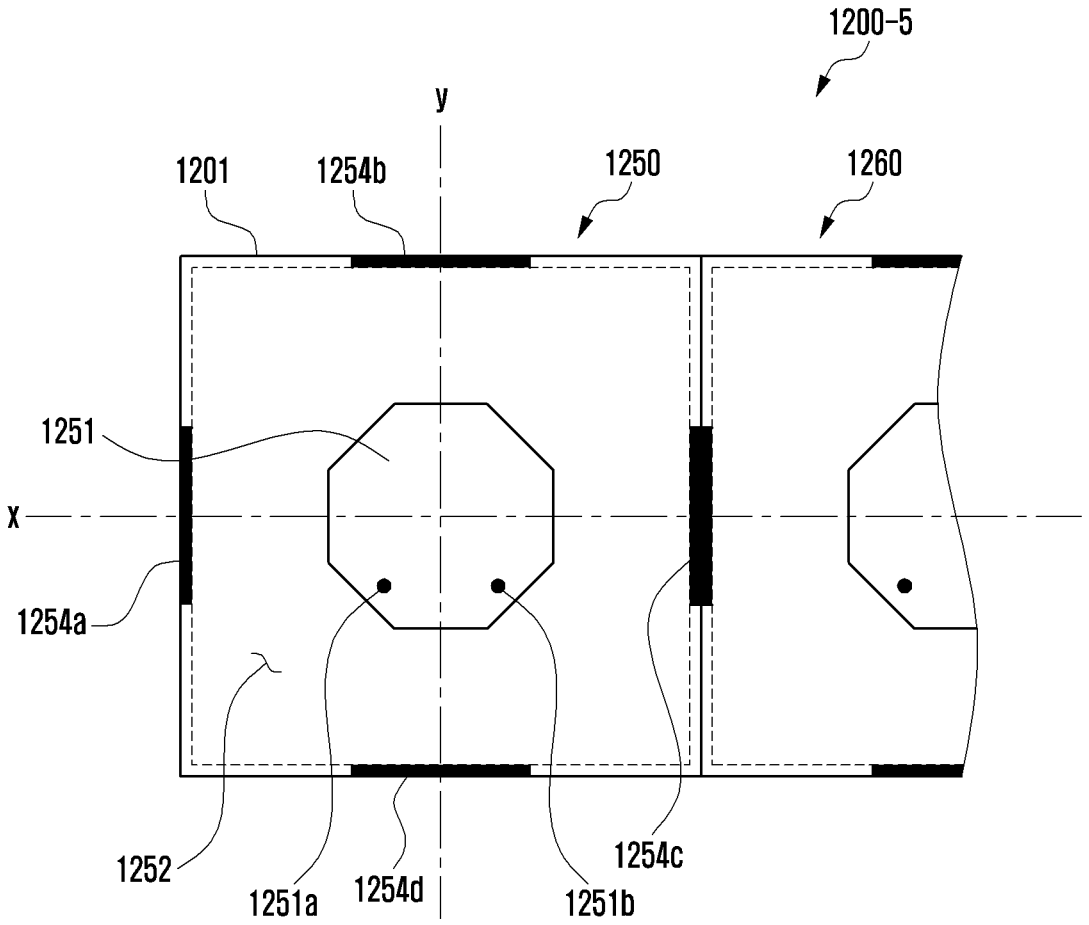

Referring to FIGS. 12D and 12E, each of the antenna modules 1200-4 and 1200-5 may include a first antenna structure 1250, a second antenna structure 1260, . . . , and an $N^{th}$ antenna structure, which are disposed at regular intervals on the PCB 1201. According to an embodiment, each of the antenna modules 1200-4 and 1200-5 may include N antenna structures disposed on one PCB 1201, and such antenna structures may have the substantially same configuration.

According to various embodiments, each of the antenna modules 1200-4 and 1200-5 may include a first conductive patch arrangement area 1252 disposed on the PCB 1201 in the same manner as in FIG. 12A, and a second conductive patch 1251 having a regular octagonal shape and surrounded by the first conductive patch arrangement area 1252. The second conductive patch 1251 may include a first feeder 1251*a* and a second feeder 1251*b*.

As shown in FIG. 12D, the antenna module 1200-4 may include first to fourth conductive walls 1253*a*, 1253*b*, 1253*c*, and 1253*d* disposed at each corner portion along the outer periphery of the first conductive patch arrangement area 1252 having a square shape.

As shown in FIG. 12E, the antenna module 1200-5 may include first to fourth conductive walls 1254*a*, 1254*b*, 1254*c*, and 1254*d* disposed at each central portion of four edges along the outer periphery of the first conductive patch arrangement area 1252 having a square shape.

In another embodiment, when each of the first conductive patch arrangement areas 1212, 1232, and 1252 is formed in a square, circular, or regular octagonal shape corresponding to each of the second conductive patches 1211, 1231, and 1251, the conductive walls may be disposed at various positions on the PCB along the outer periphery of the first conductive patch arrangement area having a square, circular, or regular octagonal shape, rather than edges or corners of the PCB 1201. In this case as well, in order to realize a dual polarization or a dual polarization and dual feeding and also ensure isolation, the conductive walls may be formed to have the same layout as the initial layout even after rotating by 90 degrees, 180 degrees, or 270 degrees.

Figure 12F:
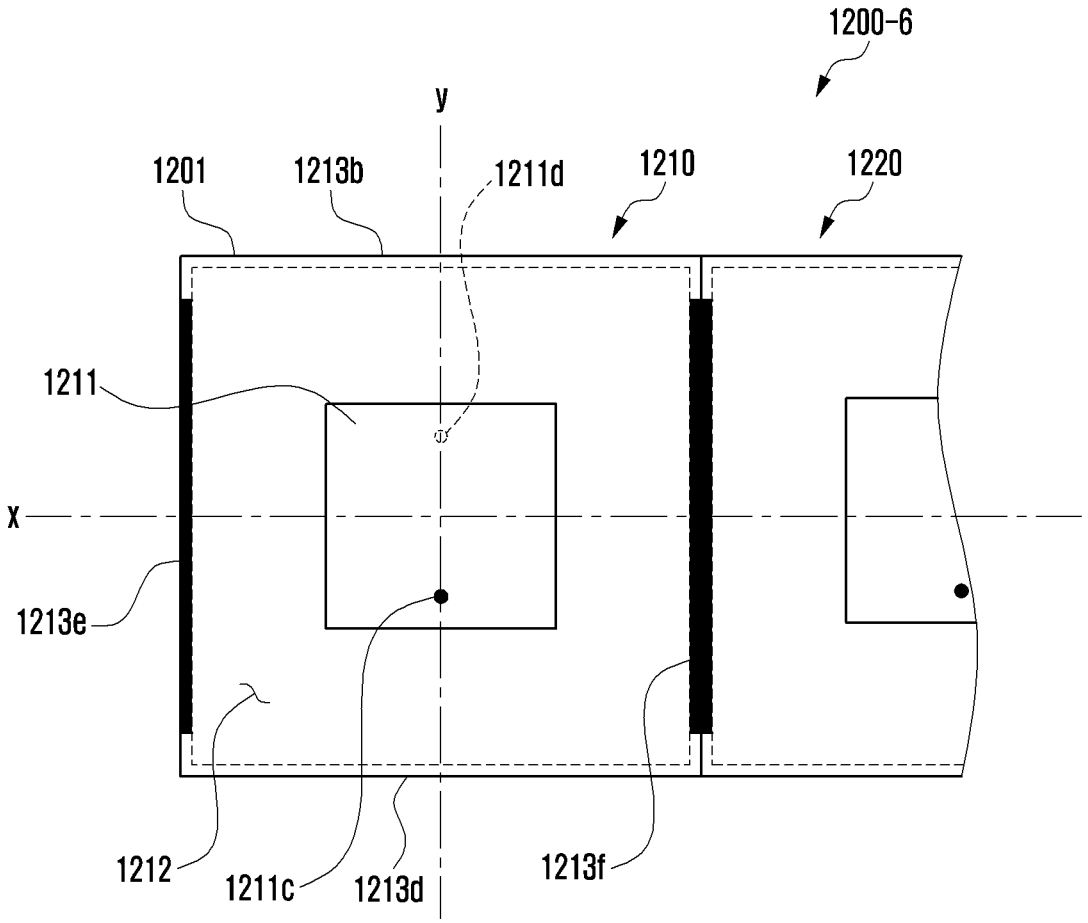
FIGS. 12F and 12G are diagrams illustrating a configuration of antenna modules according to various embodiments of the disclosure.
Figure 12G:
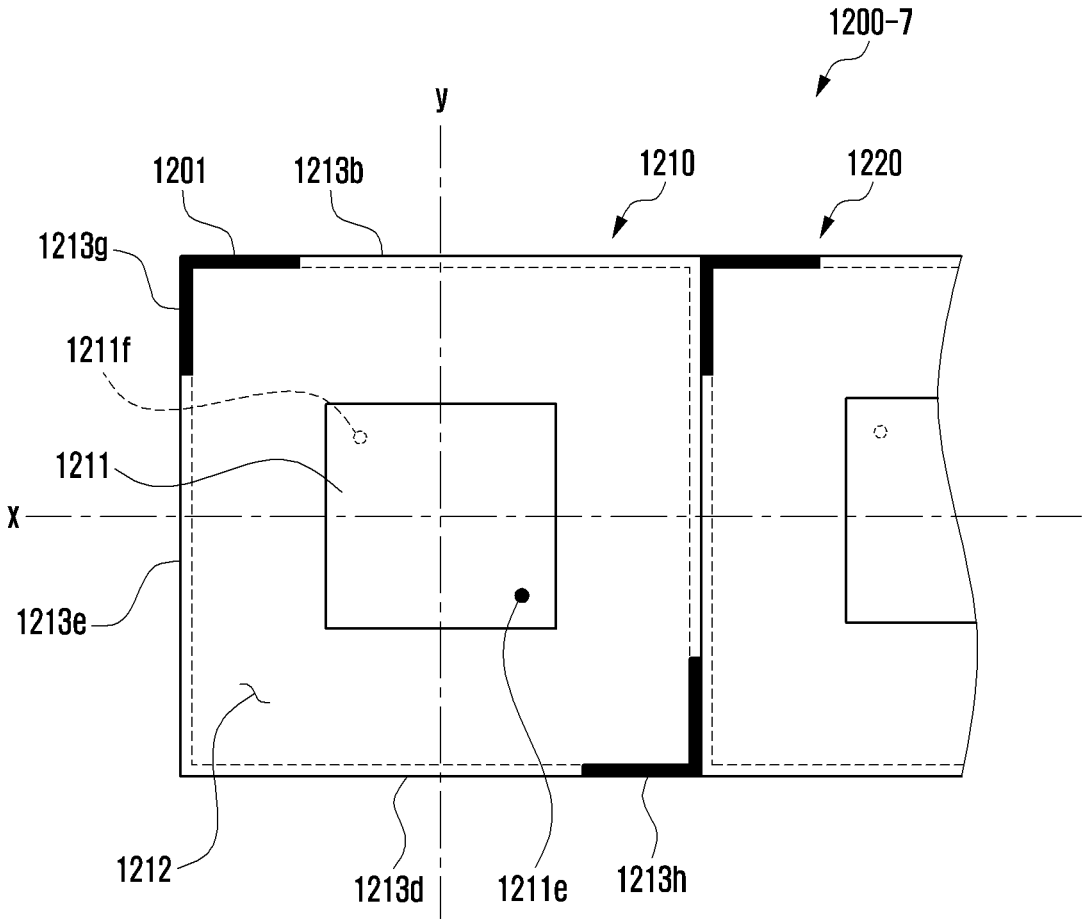

FIGS. 12F and 12G are diagrams illustrating a configuration of antenna modules according to various embodiments of the disclosure. FIGS. 12F and 12G illustrate antenna modules each of which has a configuration for a single polarization and dual feeding.

The antenna modules 1200-6 and 1200-7 shown in FIGS. 12F and 12G may be similar, at least in part, to the third antenna module 246 of FIG. 2, or may include other embodiments of the antenna module.

Referring to FIG. 12F, the antenna module 1200-6 may include a first antenna structure 1210, a second antenna structure 1220, . . . , and an $N^{th}$ antenna structure, which are disposed at regular intervals on a printed circuit board (PCB) 1201. According to an embodiment, the antenna module

1200-6 may include N antenna structures disposed on one PCB 1201, and such antenna structures may have the substantially same configuration.

According to various embodiments, the first antenna structure 1210 may include a first conductive patch arrangement area 1212 having the same layout as the initial layout even after rotating by 90 degrees, 180 degrees, or 270 degrees about an intersection between an x-axis and a y-axis perpendicular to each other. The first antenna structure 1210 may further include a second conductive patch 1211 surrounded by the first conductive patch arrangement area 1212. According to an embodiment, in order to realize a single polarization, the second conductive patch 1211 may include a first feeder 1211*c*. In another embodiment, in order to realize a single polarization and dual feeding, the second conductive patch 1211 may further include a second feeder 1211*d* disposed at a symmetrical position with respect to the x-axis. In this case, the second conductive patch 1211 may have a symmetrical shape with respect to the x-axis.

According to various embodiments, the first antenna structure 1210 may include a first conductive wall 1213*e* and a second conductive wall 1213*f* which are disposed at least in part along the outer periphery of the first conductive patch arrangement area 1212. The first conductive wall 1213*e* may be disposed at one edge of the outer periphery of the first conductive patch arrangement area 1212, and the second conductive wall 1213*f* may be disposed symmetrically with the first conductive wall 1213*e* with respect to the x-axis or y-axis. In another embodiment, the first antenna structure 1210 may include only one conductive wall disposed at any one edge of the outer periphery of the first conductive patch arrangement area 1212. In still another embodiment, the first antenna structure 1210 may include three conductive walls respectively disposed at three edges of the outer periphery of the first conductive patch arrangement area 1212.

Referring to FIG. 12G, the antenna module 1200-7 may include a first antenna structure 1210, a second antenna structure 1220, . . . , and an $N^{th}$ antenna structure, which are disposed at regular intervals on a printed circuit board (PCB) 1201. According to an embodiment, the antenna module 1200-7 may include N antenna structures disposed on one PCB 1201, and such antenna structures may have the substantially same configuration.

According to various embodiments, the first antenna structure 1210 may include a first conductive patch arrangement area 1212 having the same layout as the initial layout even after rotating by 90 degrees, 180 degrees, or 270 degrees about an intersection between an x-axis and a y-axis perpendicular to each other. The first antenna structure 1210 may further include a second conductive patch 1211 surrounded by the first conductive patch arrangement area 1212. According to an embodiment, in order to realize a single polarization, the second conductive patch 1211 may include a first feeder 1211*e*. In another embodiment, in order to realize a single polarization and dual feeding, the second conductive patch 1211 may further include a second feeder 1211*f* disposed at a symmetrical position in a diagonal direction. In this case, the second conductive patch 1211 may have a symmetrical shape with respect to the intersection between the x-axis and the y-axis.

According to various embodiments, the first antenna structure 1210 may include a first conductive wall 1213*g* and a second conductive wall 1213*h* which are disposed at least in part along the outer periphery of the first conductive patch arrangement area 1212. The first conductive wall 1213*g* may be disposed at one corner of the outer periphery of the first conductive patch arrangement area 1212, and the second conductive wall 1213*h* may be disposed at the opposite corner to be symmetrically with the first conductive wall 1213*g* with respect to the intersection between the x-axis and the y-axis. In another embodiment, the first antenna structure 1210 may include only one conductive wall disposed at any one corner of the outer periphery of the first conductive patch arrangement area 1212. In still another embodiment, the first antenna structure 1210 may include three conductive walls respectively disposed at three corners of the outer periphery of the first conductive patch arrangement area 1212.

Figure 12H:
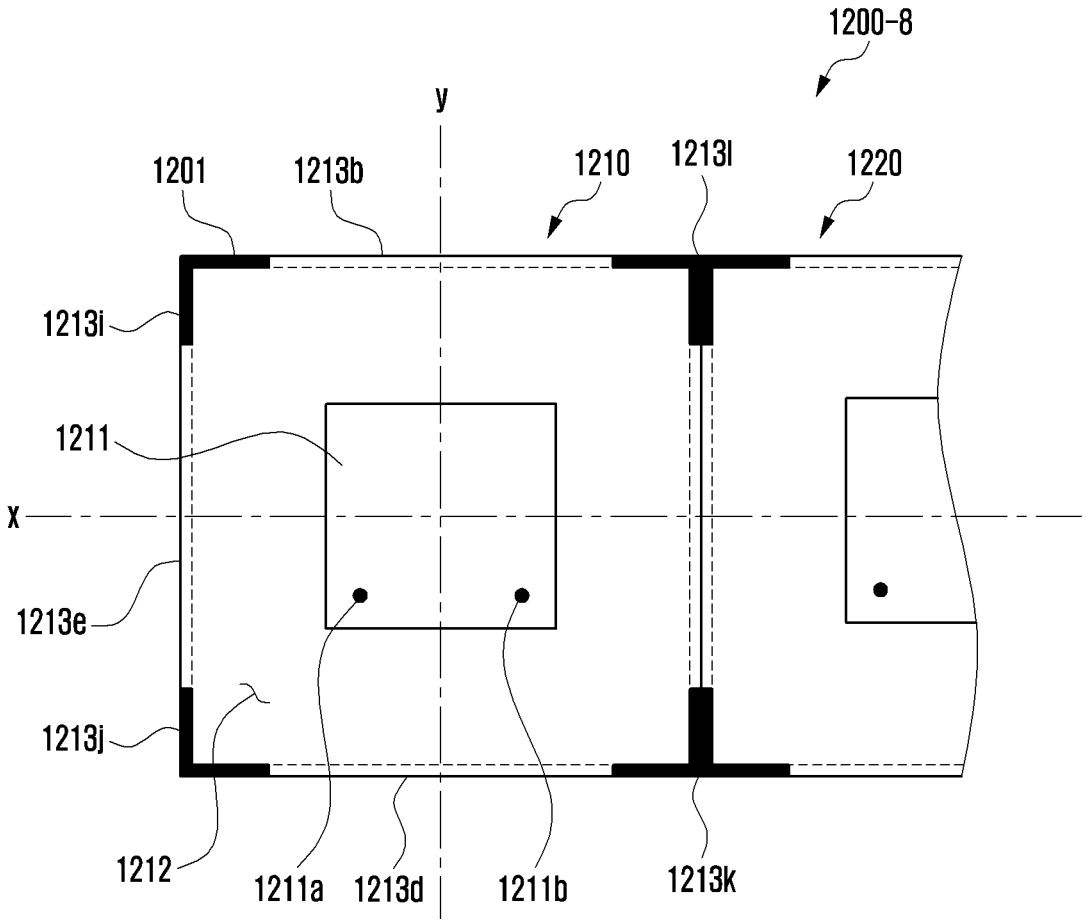
FIG. 12H is a diagram illustrating a configuration of an antenna module according to an embodiment of the disclosure.

FIG. 12H is a diagram illustrating a configuration of an antenna module 1200-8 according to an embodiment of the disclosure.

The antenna module 1200-8 shown in FIG. 12H may be similar, at least in part, to the third antenna module 246 of FIG. 2, or may include other embodiments of the antenna module.

Referring to FIG. 12H, the antenna module 1200-8 may include a first antenna structure 1210, a second antenna structure 1220, . . . , and an $N^{th}$ antenna structure, which are disposed at regular intervals on a printed circuit board (PCB) 1201. According to an embodiment, the antenna module 1200-8 may include N antenna structures disposed on one PCB 1201, and such antenna structures may have the substantially same configuration.

According to various embodiments, the first antenna structure 1210 may include a first conductive patch arrangement area 1212 having the same layout as the initial layout even after rotating by 90 degrees, 180 degrees, or 270 degrees about an intersection between an x-axis and a y-axis perpendicular to each other. The first antenna structure 1210 may further include a second conductive patch 1211 surrounded by the first conductive patch arrangement area 1212. According to an embodiment, in order to realize a dual polarization, the second conductive patch 1211 may include a first feeder 1211*a* and a second feeder 1211*b*. According to an embodiment, in order to realize a dual polarization, the second conductive patch 1211 may have a symmetrical shape with respect to the y-axis.

According to various embodiments, the first antenna structure 1210 may include a first conductive wall 1213*i*, a second conductive wall 1213*j*, a third conductive wall 1213*k*, and a fourth conductive wall 1213*l* which are disposed at least in part along the outer periphery of the first conductive patch arrangement area 1212. According to an embodiment, the first conductive wall 1213*i*, the second conductive wall 1213*j*, the third conductive wall 1213*k*, and the fourth conductive wall 1213*l* may be disposed at respective corners of the outer periphery of the first conductive patch arrangement area 1212. According to an embodiment, at least some of the conductive walls 1213*i*, 1213*j*, 1213*k*, and 1213*l* of the first antenna structure 1210 may be used in common with adjacent conductive walls of the second antenna structure 1220. For example, the third conductive wall 1213*k* and the fourth conductive wall 1213*l* of the first antenna structure 1210 may be used together as conductive walls of the second conductive structure 1220 which is adjacent to the first antenna structure 1210. As such, one antenna structure (e.g., the first antenna structure 1210) may share at least one conductive wall with an adjacent antenna structure (e.g., the second antenna structure 1220), so that the volume of the antenna module 1200-8 may be reduced.

Figure 13A:
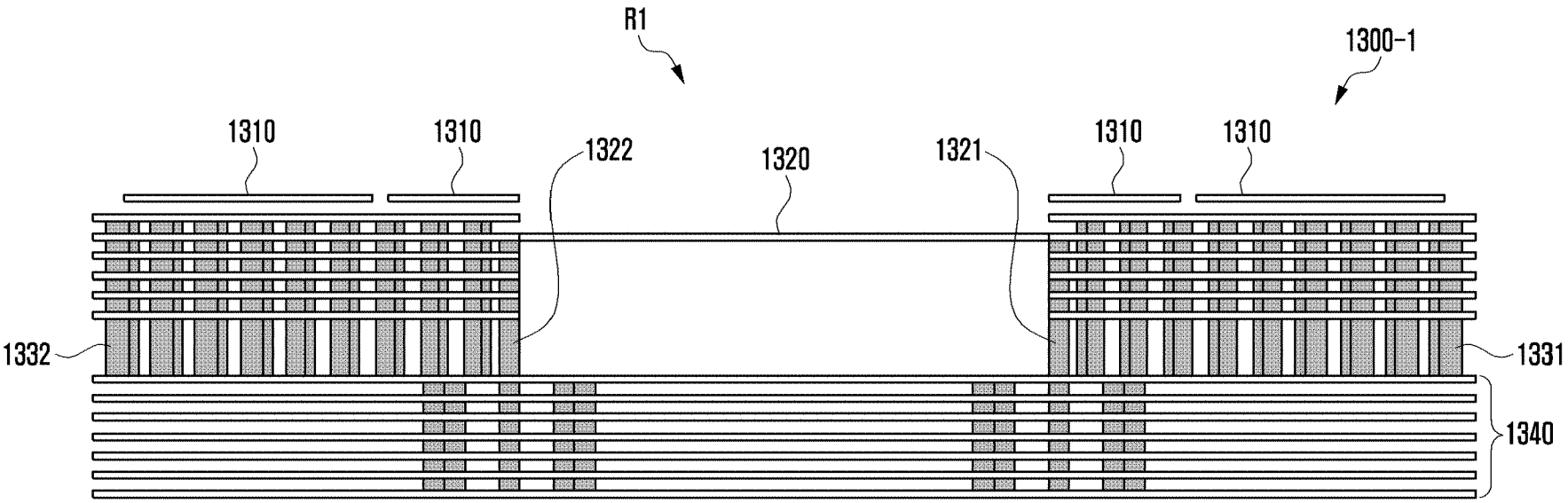
FIGS. 13A and 13B are diagrams illustrating an arrangement relationship between a second conductive patch and conductive walls according to various embodiments of the disclosure.
Figure 13B:
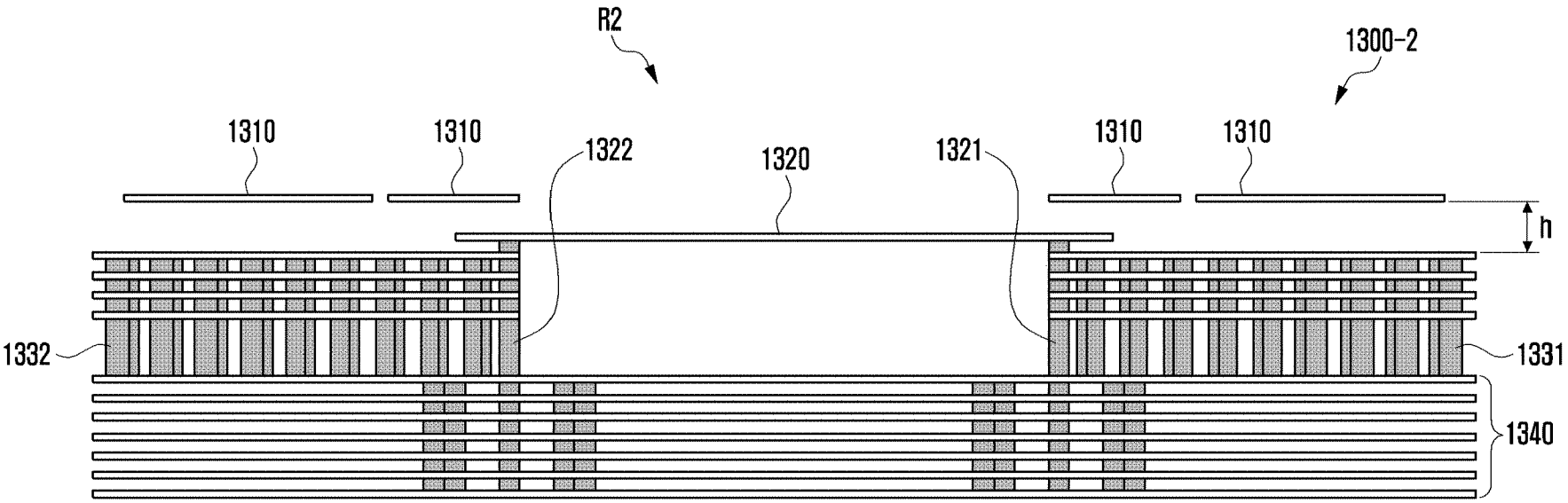

FIGS. 13A and 13B are diagrams illustrating an arrangement relationship between a second conductive patch 1320 and conductive walls 1331 and 1332 according to various embodiments of the disclosure.

Antenna modules 1300-1 and 1300-2 shown in FIGS. 13A and 13B may be similar, at least in part, to the third antenna module 246 of FIG. 2, or may include other embodiments of the antenna module.

Referring to FIG. 13A, the antenna module 1300-1 may include an antenna structure R1. The antenna structure R1 may include first conductive patches 1310, a second conductive patch 1320 disposed to be surrounded by the first conductive patches 1310, and one or more conductive walls 1331 and 1332 disposed along an outer periphery of the first conductive patches 1310. According to an embodiment, the one or more conductive walls 1331 and 1332 may be electrically connected to a ground layer 1340 disposed in the antenna structure R1, and also disposed at a position capable of being capacitively coupled with the first conductive patches 1310. According to an embodiment, the antenna structure R1 may include one or more feeders 1321 and 1322 for electrically connecting the second conductive patch 1320 to a wireless communication circuit (e.g., 595 in FIG. 5A).

According to various embodiments, the second conductive patch 1320 may be disposed at a position lower in the vertical direction than one ends of the conductive walls 1331 and 1332 which are disposed to be capacitively coupled with the first conductive patches 1310. That is, in the vertical direction, one ends of the conductive walls 1331 and 1332 may be disposed closer to the first conductive patches 1310 than the second conductive patch 1320 is.

Referring to FIG. 13B, the antenna module 1300-2 may include an antenna structure R2. According to an embodiment, the antenna structure R2 may include the second conductive patch 1320 which is disposed closer to the first conductive patches 1310 in the vertical direction than one ends of the conductive walls 1331 and 1332 are. In this case, a gap (h) between the ends of the conductive walls 1331 and 1332 and the first conductive patches 1310 may be adjusted in the range of coupling.

Figure 14:
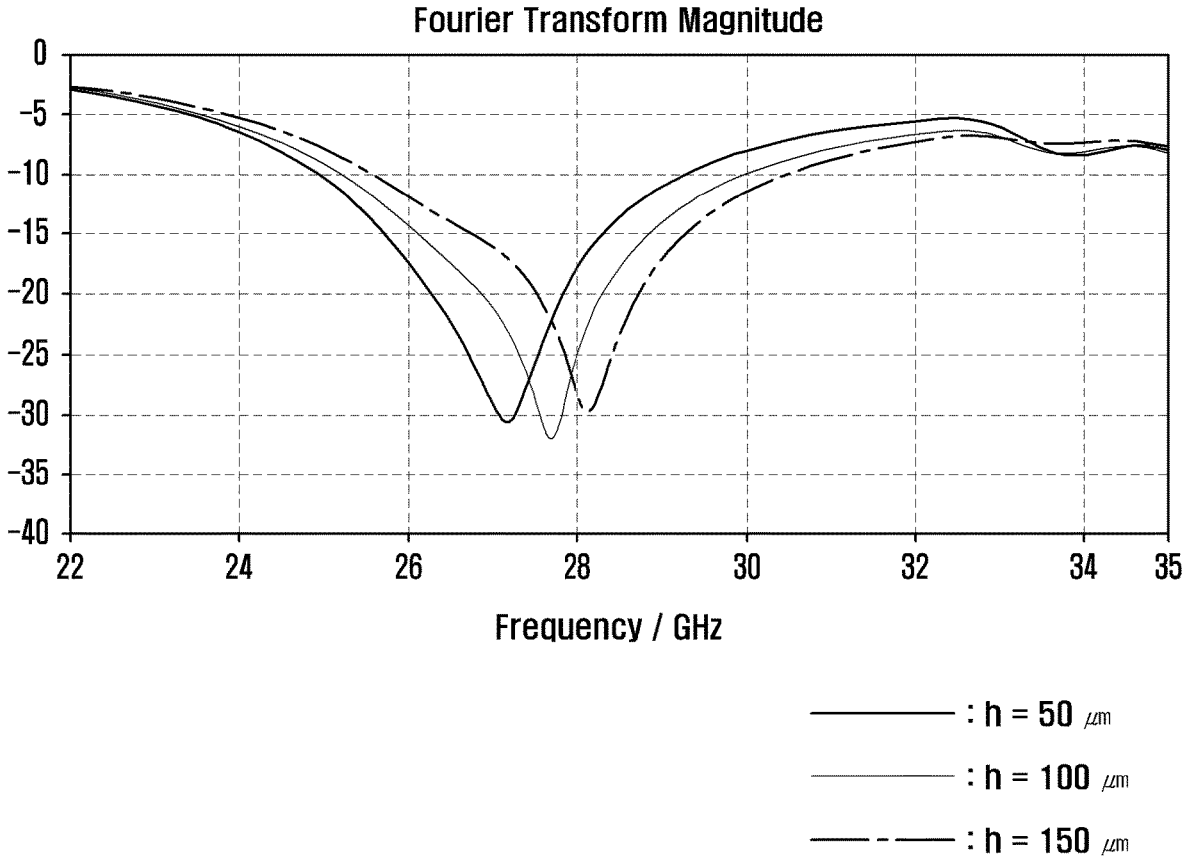
FIG. 14 is a graph showing a frequency characteristic with a change in gap between a first conductive patch and a conductive wall shown in FIG. 13B according to an embodiment of the disclosure.

FIG. 14 is a graph showing a frequency characteristic with a change in gap (h) between the first conductive patches 1310 and the conductive walls 1331 and 1332 shown in FIG. 13B according to an embodiment of the disclosure.

Referring to FIG. 14, as the gap (h) between the ends of the conductive walls (e.g., 1331 and 1332 in FIG. 13B) and the first conductive patches (1310 in FIG. 13B) increases, that is, as the amount of coupling between the conductive walls 1331 and 1332 and the first conductive patches 1310 decreases, the capacitance decreases, and thus the operating frequency band of the antenna module 1300-2 is shifted to a higher frequency band.

The antenna module 1300-2 according to embodiments may affect a frequency design because the operating frequency band is determined by adjusting the gap (h) between the conductive walls 1331 and 1332 and the first conductive patches 1310. In another embodiment, the operating frequency band of the antenna module 1300-2 may be determined by adjusting coupling areas of the conductive walls 1331 and 1332 while the gap between the conductive walls 1331 and 1332 and the first conductive patches 1310 is maintained.

Figure 15:
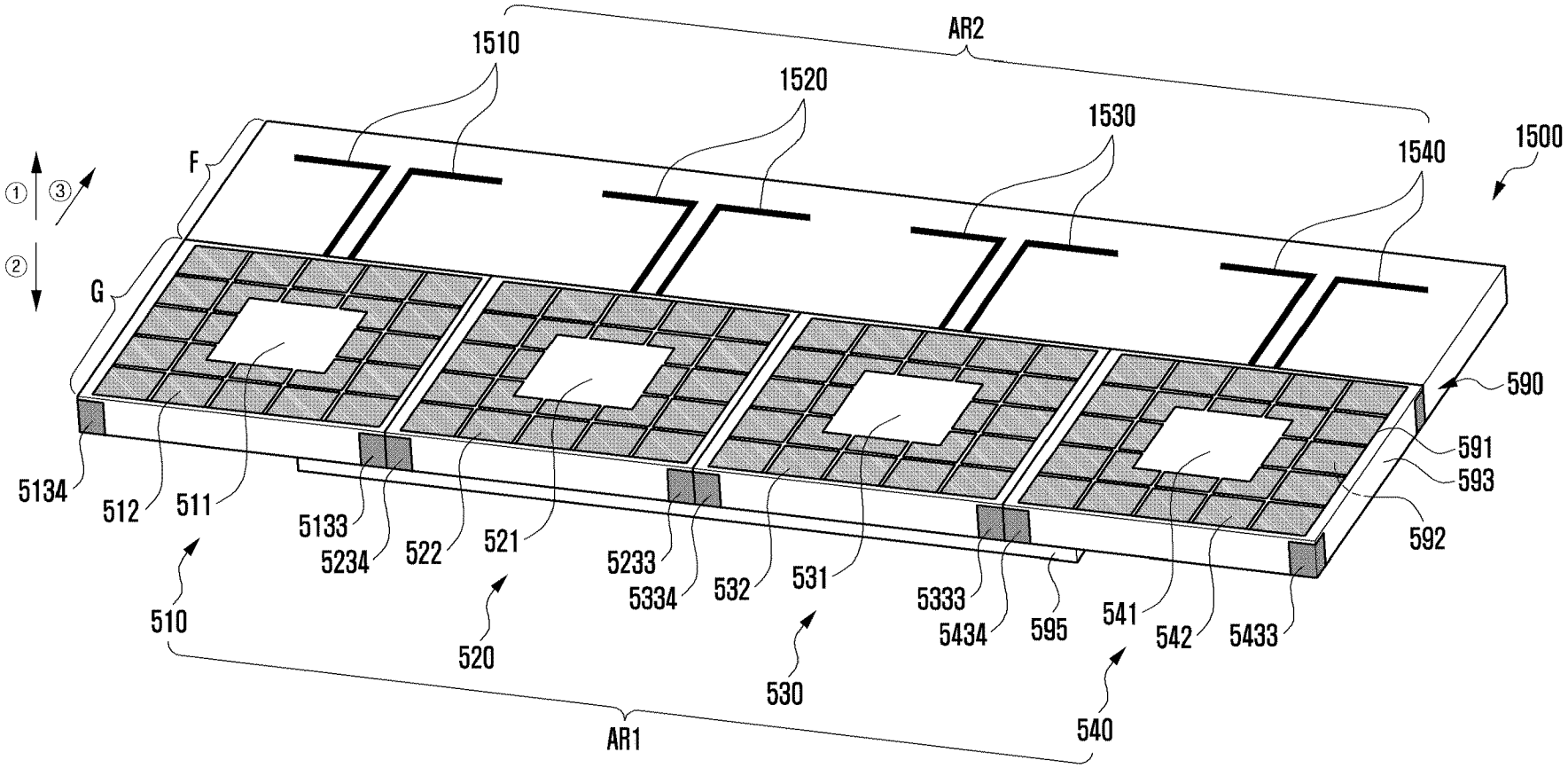
FIG. 15 is a perspective view showing an antenna module according to an embodiment of the disclosure.

FIG. 15 is a perspective view showing an antenna module 1500 according to an embodiment of the disclosure.

The antenna module 1500 shown in FIG. 15 may be similar, at least in part, to the third antenna module 246 of FIG. 2, or may include other embodiments of the antenna module.

A first antenna array AR1 of the antenna module 1500 shown in FIG. 15 has the substantially same configuration as the above-described antenna array AR1 shown in FIGS. 5A and 5B, so that a detailed description will be omitted.

Referring to FIG. 15, the antenna module 1500 may include the first antenna array AR1 and a second antenna array AR2 which are disposed on the PCB 590. According to an embodiment, the PCB 590 may have the first surface 591 facing a first direction (indicated by ①, e.g., the −Z direction in FIG. 3B), the second surface 592 facing a direction (indicated by ②, e.g., the Z direction in FIG. 3A) opposite to the first surface 591, and the lateral surface 593 that surrounds a space between the first and second surfaces 591 and 592. According to an embodiment, the antenna module 1500 may include the wireless communication circuit 595 disposed on the second surface 592 of the PCB 590. According to an embodiment, the PCB 590 may include a ground region G and a fill and cut region F (e.g., a non-conductive region) adjacent to the ground region G. In the ground region G, the first antenna array AR1 is disposed, and a ground layer (e.g., the ground layer 5503 in FIG. 6A) may be included.

According to various embodiments, the second antenna array AR2 may include a plurality of conductive patterns 1510, 1520, 1530, and 1540 in the fill and cut region F of the PCB 590. According to an embodiment, the plurality of conductive patterns 1510, 1520, 1530, and 1540 may include a first conductive pattern 1510 disposed near the first antenna structure 510, a second conductive pattern 1520 disposed near the second antenna structure 520, a third conductive pattern 1530 disposed near the third antenna structure 530, and a fourth conductive pattern 1540 disposed near the fourth antenna structure 540. According to an embodiment, the plurality of conductive patterns 1510, 1520, 1530, and 1540 may be electrically connected to the wireless communication circuit 595. According to an embodiment, the plurality of conductive patterns 1510, 1520, 1530, and 1540 may operate as a dipole antenna. According to an embodiment, the wireless communication circuit 595 may be configured to transmit and/or receive a radio frequency signal in the range of about 3 GHz to 100 GHz via the second antenna array AR2.

According to various embodiments, the antenna module 1500 may be configured to form a beam pattern in the first direction (denoted by CD, e.g., the −Z direction in FIG. 3B) through the first antenna array AR1. According to an embodiment, the antenna module 1500 may be configured to form a beam pattern in the third direction (denoted by ③, e.g., the X direction, the −X direction, the Y direction, or the −Y direction in FIGS. 3A and 3B) perpendicular to the first direction through the second antenna array AR2.

According to various embodiments, the antenna module 1500 may include the first antenna array AR1 composed of the antenna structures 510, 520, 530, and 540 disposed in one by four array, and the second antenna array AR2 composed of the conductive patterns 1510, 1520, 1530, and 1540 disposed in one by four array. In another embodiment, the antenna module 1500 may include one antenna structure and one conductive pattern. In still another embodiment, the antenna module may include antenna structures and conductive patterns, each of both being disposed in multi-row multi-column array.

Figure 16:
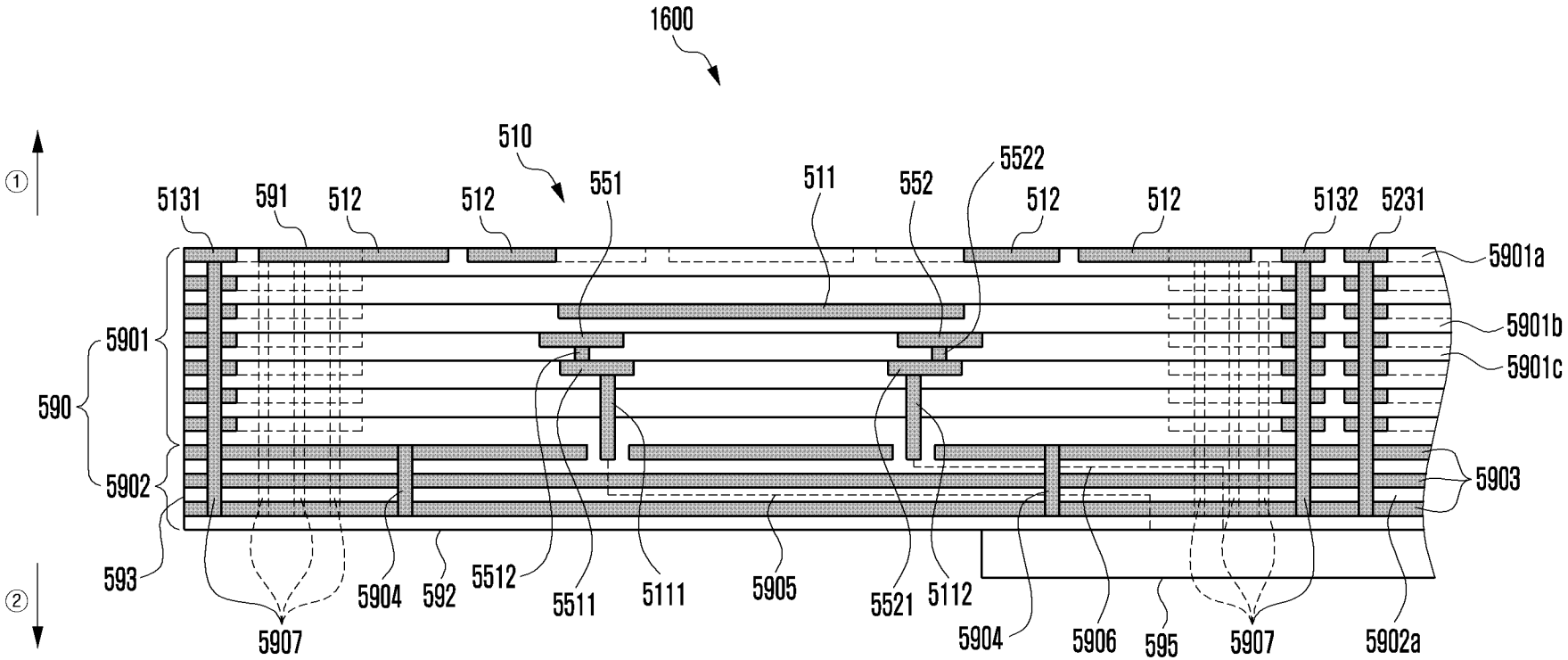
FIG. 16 is a cross-sectional view partially showing a stack structure of an antenna module according to an embodiment of the disclosure.

FIG. 16 is a cross-sectional view partially showing a stack structure of an antenna module 1600 according to an embodiment of the disclosure.

The antenna module 1600 of FIG. 16 may be similar, at least in part, to the third antenna module 246 of FIG. 2, or may include other embodiments of the antenna module.

Excepting a feeding structure of the second conductive patch 511, the antenna module 1600 of FIG. 16 has the substantially same configuration as that of the antenna module 500 of FIG. 6A. Thus, a detailed description will be omitted.

Referring to FIG. 16, the antenna module 1600 may include the first conductive patches 512 disposed on the first insulating layer 5901*a* in the first layer region 5901 of the PCB 590, and the second conductive patch 511 disposed between the first insulating layer 5901*a* and the ground layer 5903 formed on the third insulating layer 5902*a* in the second layer region 5902.

According to various embodiments, the second conductive patch 511 may be electrically connected to and capacitively coupled with a pair of feeding pads 551 and 552, which are spaced apart from each other on a fourth insulating layer 5901*c* interposed between the second insulating layer 5901*b* and the third insulating layer 5902*a* in the first layer region 5901. According to an embodiment, the first feeding pad 551 may be electrically connected to a first feeder 5111 through a first conductive connector 5511 and a first conductive via 5512. Similarly, the second feeding pad 552 may be electrically connected to a second feeder 5112 through a second conductive connector 5521 and a second conductive via 5522. According to an embodiment, each of the first and second conductive connectors 5511 and 5521 may be formed in a pad shape having a certain area. According to an embodiment, each of the feeders 5111 and 5112 and a corresponding one of the conductive vias 5512 and 5522 may be arranged to be inconsistent or coincident with each other in the vertical direction of the PCB 590.

According to various embodiments, the antenna module 1600 may have an improved design freedom through the first and second feeding pads 551 and 552 that indirectly feed (e.g., coupling) the second conductive patch 511 with power. According to an embodiment, in the antenna module 1600, adjusting the capacitance through the coupling area and/or gap between the second conductive patch 511 and each of the first and second feeding pads 551 and 552 can determine and adjust the antenna characteristics such as expanding the bandwidth and/or shifting the operating frequency band.

Figure 17:
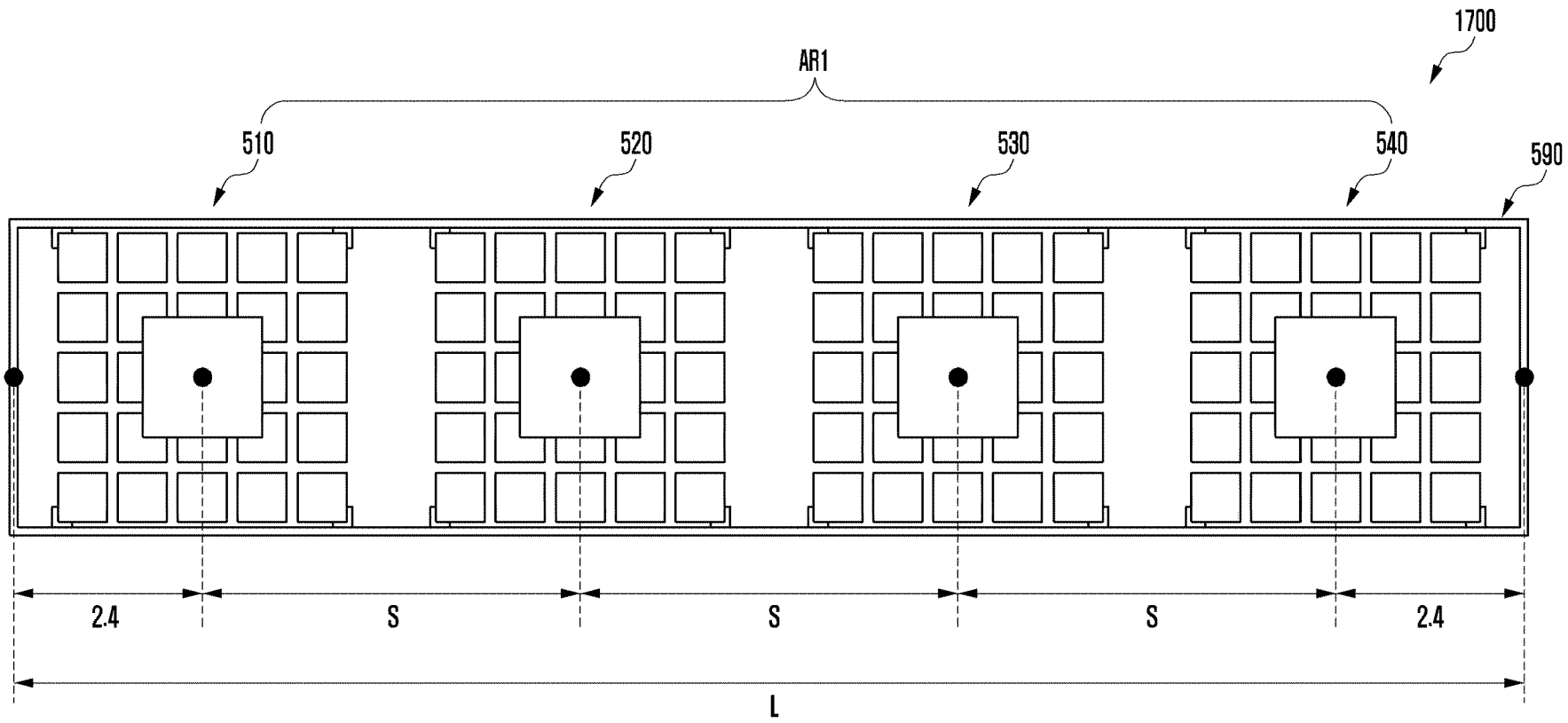
FIG. 17 is a diagram illustrating a configuration of an antenna module according to an embodiment of the disclosure.

FIG. 17 is a diagram illustrating a configuration of an antenna module 1700 according to an embodiment of the disclosure.

The antenna module 1700 of FIG. 17 may be similar, at least in part, to the third antenna module 246 of FIG. 2, or may include other embodiments of the antenna module.

A first antenna array AR1 of the antenna module 1700 shown in FIG. 17 has the substantially same configuration as the above-described antenna array AR1 shown in FIGS. 5A and 5B, so that a detailed description will be omitted.

Referring to FIG. 17, the antenna module 1700 may include the first antenna structure 510, the second antenna structure 520, the third antenna structure 530, and the fourth antenna structure 540, which are disposed at regular spacings (S) on the PCB 590.

According to various embodiments, in the antenna module 1700, the frequency characteristics may be determined depending on the spacing between the antenna structures 510, 520, 530, and 540. For example, increasing the spacing (S) between the antenna structures 510, 520, 530, and 540 can improve the gain in a first mmWave frequency band (e.g., from about 24.25 GHz to about 29.5 GHz) (e.g., a 28 GHz band).

According to various embodiments, even if the antenna structures 510, 520, 530, and 540 are arranged at a spacing (S) of a half wavelength at a specific frequency, the spacing may not be the half wavelength at another frequency because the 5G mmWave is used in a wide band rather than a single frequency. For example, even if the antenna structures are arranged at a half-wavelength spacing in case of 28 GHz, an arrangement spacing may be reduced than the half wavelength in case of a low frequency used in the mmWave. Unfortunately, this may cause a decrease in gain of the antenna module.

According to embodiments of the disclosure, the total length (L) of the PCB may be increased by increasing the spacing (S) between the antenna structures 510, 520, 530, and 540. In this case, as shown in Table 1 below, as the spacing (S) increases, the electrical length of the antenna module increases, and thus the gain in a low frequency band is improved.

TABLE 1

| | Operating Frequency Band (GHz) | | |
|---|---|---|---|
| Spacing (mm) | 24.25 GHz | 26.8 GHz | 29.5 GHz |
| 4.8 | 0.39λ | 0.43λ | 0.47λ |
| 5.4 | 0.44λ | 0.48λ | 0.53λ |
| 6.0 | 0.49λ | 0.54λ | 0.59λ |

Figure 18:
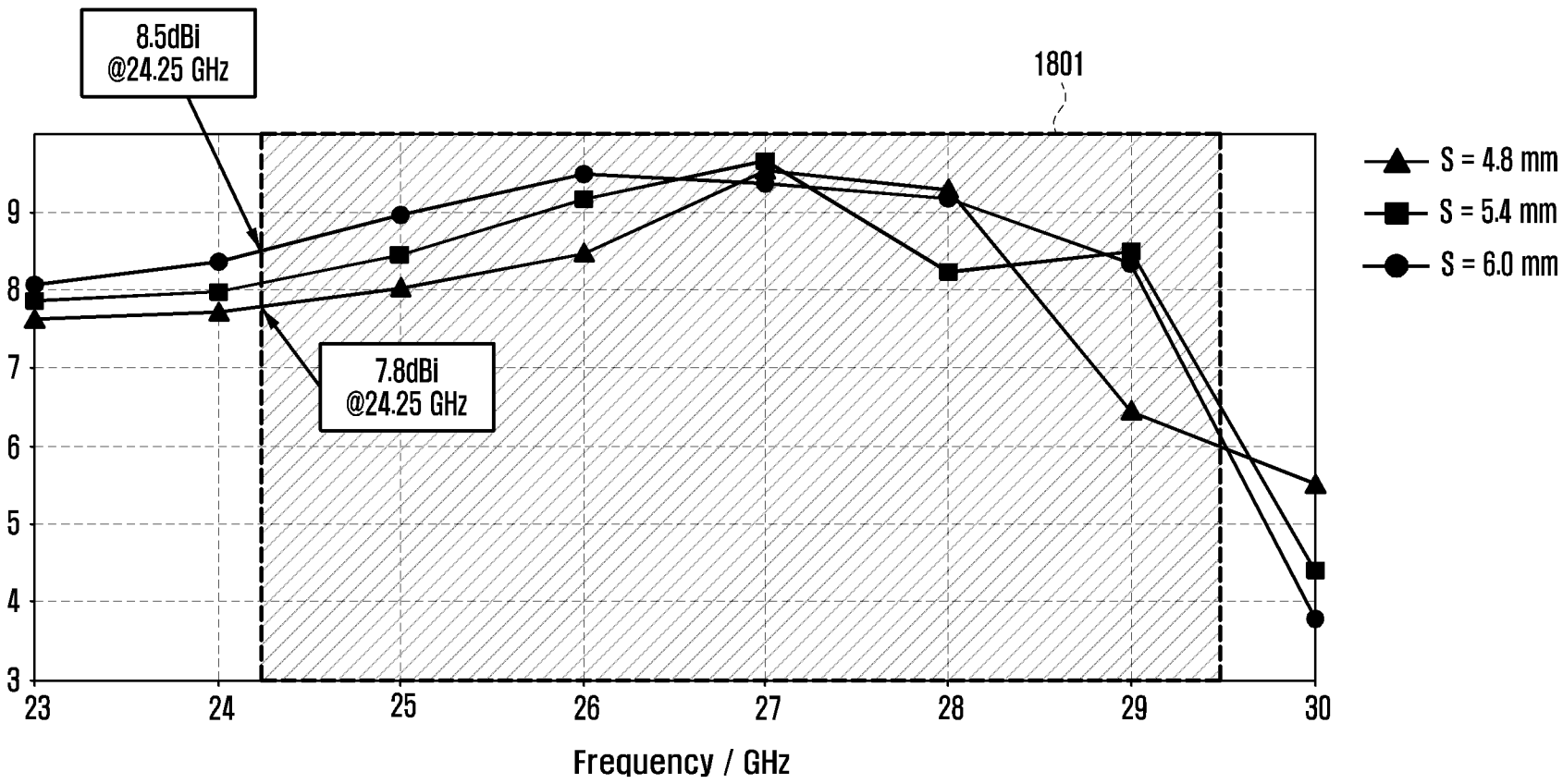
FIG. 18 is a graph showing a frequency characteristic according to a spacing between the antenna structures shown in FIG. 17 according to an embodiment of the disclosure.

FIG. 18 is a graph showing a frequency characteristic according to a spacing (S) between the antenna structures 510, 520, 530, and 540 shown in FIG. 17 according to an embodiment of the disclosure.

Referring to FIG. 18, when the spacing (S) between the antenna structures 510, 520, 530, and 540 is 4.8 mm, the antenna module 1700 has a gain of 7.8 dBi in a band of about 24.25 GHz. However, when the spacing (S) between the antenna structures 510, 520, 530, and 540 is increased to 6.0 mm, the antenna module 1700 has a gain of about 8.5 dBi in the same frequency band, that is, having an increase in a gain of about 0.7 dBi. This means that, when the spacing (S) between the antenna structures 510, 520, 530, and 540 increases in a low frequency band (e.g., a region 1801 in FIG. 18), the antenna gain may increase. Also, this means that it may be helpful for expanding the bandwidth.

In another embodiment, the antenna characteristics of the antenna module 1700 may be determined by arranging the antenna structures 510, 520, 530, and 540 to have different spacings (S). For example, the beam steering of the antenna module may be induced by gradually increasing or decreasing the spacings (S) between the antenna structures 510, 520, 530, and 540.

According to various embodiments of the disclosure, an antenna structure includes a plurality of first conductive patches periodically disposed around a second conductive patch, and also includes one or more conductive walls having one end electrically connected to a ground layer and the other end disposed to be capacitively coupled with the first conductive patches. This makes it possible to design an antenna that operates without a reduction in radiation efficiency in a relatively wide frequency band.

According to various embodiments of the disclosure, an electronic device may include a housing (e.g., the housing 310 in FIG. 3A) including a first plate (e.g., the front plate 302 in FIG. 3A), a second plate (e.g., the rear plate 311 in FIG. 3B) facing a direction opposite to the first plate, and a lateral member (e.g., the side bezel structure 318 in FIG. 3A) surrounding a space between the first plate and the second plate and connected to or integrally formed with the second plate. The electronic device may further include a display (e.g., the display 301 in FIG. 3A) disposed in the space to be visible from outside through at least a part of the first plate, and at least one antenna structure (e.g., the first antenna structure 510 in FIG. 5B) disposed in the space of the housing, including a first surface (e.g., the first surface 591 in FIG. 5A) and a second surface (e.g., the second surface 592 in FIG. 5A) facing a direction opposite to the first surface, and including a first area (e.g., the first area 5101 in FIG. 5B) and a second area (e.g., the second area 5102 in FIG. 5B) surrounded by the first area when viewed from above the first surface. The antenna structure may also include a plurality of insulating layers (e.g., the insulating layers 5901 and 5902 in FIG. 6A) disposed between the first surface and the second surface; first conductive patches (e.g., the first conductive patches 512 in FIG. 6A) disposed in the first area, when viewed from above the first surface, and disposed on the first surface or on a first insulating layer (e.g., the first insulating layer 5901*a* in FIG. 6B) closer to the first surface than the second surface; a second conductive patch (e.g., the second conductive patch 511 in FIG. 6A) overlapped at least in part with the second area, when viewed from above the first surface, and disposed on a second insulating layer (e.g., the second insulating layer 5901*b* in FIG. 6A) between the first insulating layer and the second surface; a ground layer (e.g., the ground layer 5903 in FIG. 6A) disposed on a third insulating layer (e.g., the third insulating layer 5902*a* in FIG. 6A) between the second insulating layer and the second surface or on the second surface; and one or more conductive walls (e.g., the conductive walls 5131 and 5132 in FIG. 6A) formed along at least a portion of an outer periphery of the first area, when viewed from above the first surface, and extended from the first insulating layer to the ground layer. The electronic device may further include at least one wireless communication circuit (e.g., the wireless communication circuit 595 in FIG. 6A) electrically connected to the second conductive patch and configured to transmit and/or receive a signal having a frequency between about 3 GHz and about 100 GHz.

According to various embodiments, when viewed from above the first surface, the first conductive patches may be overlapped at least in part with the second conductive patch.

According to various embodiments, the wireless communication circuit may be disposed on the second surface.

According to various embodiments, the one or more conductive walls may include a plurality of conductive vias.

According to various embodiments, when viewed from above the first surface, the first conductive patches may be disposed not to be overlapped with the second conductive patch.

According to various embodiments, the one or more conductive walls may be disposed to be capacitively coupled, at least in part, with the first conductive patches.

According to various embodiments, the second conductive patch may be formed in a shape having a four-direction symmetry structure.

According to various embodiments, an arrangement area of the first conductive patches may have a same layout as an initial layout after rotating.

According to various embodiments, an electronic device may include a housing (e.g., the housing 310 in FIG. 3A) including a first plate (e.g., the front plate 302 in FIG. 3A), a second plate (e.g., the rear plate 311 in FIG. 3B) facing a direction opposite to the first plate, and a lateral member (e.g., the side bezel structure 318 in FIG. 3A) surrounding a space between the first plate and the second plate and connected to or integrally formed with the second plate; a printed circuit board (e.g., the PCB 590 in FIG. 5A) disposed in the space of the housing, including a first surface (e.g., the first surface 591 in FIG. 5A) and a second surface (e.g., the second surface 592 in FIG. 5A) facing a direction opposite to the first surface, and including a first area (e.g., the first area 5101 in FIG. 5B) and a second area (e.g., the second area 5102 in FIG. 5B) surrounded by the first area when viewed from above the first surface; a plurality of insulating layers (e.g., the insulating layers 5901 and 5902 in FIG. 6A) disposed between the first surface and the second surface; first conductive patches (e.g., the first conductive patches 512 in FIG. 6A) overlapped at least in part with the first area, when viewed from above the first surface, and exposed to the first surface or disposed on an insulating layer closer to the first surface between the first surface and the second surface; a second conductive patch (e.g., the second conductive patch 511 in FIG. 6A) overlapped at least in part with the second area, when viewed from above the first surface, and disposed on an insulating layer; at least one ground layer (e.g., the ground layer 5903 in FIG. 6A) disposed on the second surface or on an insulating layer between the second conductive patch and the second surface; one or more conductive walls (e.g., the conductive walls 5131 and 5132 in FIG. 6A) extended from at least a portion of an outer periphery of the first area, when viewed from above the first surface, and disposed at a position capable of being capacitively coupled with the first conductive patches; and at least one wireless communication circuit (e.g., the wireless communication circuit 595 in FIG. 6A) electrically connected to the second conductive patch through the plurality of insulating layers and configured to transmit and/or receive a signal having a frequency between about 3 GHz and about 100 GHz.

According to various embodiments, when viewed from above the first surface, the first conductive patches and the second conductive patch may be disposed on different insulating layers (e.g., the first insulating layer 5901*a* and the second insulating layer 5901*b* in FIG. 6A), and when viewed from above the first surface, the first conductive patches may be overlapped at least in part with the second conductive patch.

According to various embodiments, the first conductive patches and the second conductive patch may be disposed on a same insulating layer (e.g., the first insulating layer 5901*a* or the second insulating layer 5901*b* in FIG. 6A).

According to various embodiments, when viewed from above the first surface, the one or more conductive walls may be disposed to be overlapped at least in part with or not overlapped with the first conductive patches.

According to various embodiments, the conductive wall may be disposed, in a direction (e.g., indicated by ① in FIG. 6A) perpendicular to the first surface, closer to the first conductive patches than the second conductive patch is.

According to various embodiments, the conductive wall may be disposed, in a direction (e.g., indicated by ① in FIG. 6A) perpendicular to the first surface, farther to the first conductive patches than the second conductive patch is.

According to various embodiments, the wireless communication circuit may be disposed on the second surface.

According to various embodiments, the one or more conductive walls may include a plurality of conductive vias vertically penetrating at least a portion of insulating layers of the printed circuit board.

According to various embodiments, the second conductive patch may be disposed to be capacitively coupled, at least in part, with the first conductive patches.

According to various embodiments, the second conductive patch may be formed in a shape having a four-direction symmetry structure.

According to various embodiments, an arrangement area of the first conductive patches may have a same layout as an initial layout after rotating.

According to various embodiments, the electronic device may further include a display (e.g., the display 301 in FIG. 3A) disposed in the space to be visible from outside through at least a part of the first plate.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing including a first plate, a second plate facing a direction opposite to the first plate, and a lateral member surrounding a space between the first plate and the second plate and connected to or integrally formed with the second plate;

a display disposed in the space of the housing so as to be visible from outside the housing through at least a part of the first plate;

at least one antenna structure disposed in the space of the housing, including a first surface and a second surface facing a direction opposite to the first surface, including a first area and a second area surrounded by the first area when viewed from above the first surface, and including:

a plurality of insulating layers disposed between the first surface and the second surface;

first conductive patches disposed in the first area, when viewed from above the first surface, and disposed on the first surface or on a first insulating layer closer to the first surface than the second surface;

a second conductive patch overlapped at least in part with the second area, when viewed from above the first surface, and disposed on a second insulating layer between the first insulating layer and the second surface;

a ground layer disposed on a third insulating layer between the second insulating layer and the second surface or on the second surface; and one or more conductive walls formed along at least a portion of an outer periphery of the first area, when viewed from above the first surface, and extended from the first insulating layer to the ground layer; and at least one wireless communication circuit electrically connected to the second conductive patch and configured to at least one of transmit or receive a signal having a frequency between 3 GHz and 100 GHz, wherein the one or more conductive walls are disposed at a position so as to be capacitively coupled with the first conductive patches, and wherein the second conductive patch is capacitively coupled with at least one of the first conductive patches.

2. The electronic device of claim 1, wherein, when viewed from above the first surface, the first conductive patches are overlapped at least in part with the second conductive patch.

3. The electronic device of claim 1, wherein the wireless communication circuit is disposed on the second surface.

4. The electronic device of claim 1, wherein the one or more conductive walls include a plurality of conductive vias.

5. The electronic device of claim 1, wherein, when viewed from above the first surface, the first conductive patches are disposed not to be overlapped with the second conductive patch.

6. The electronic device of claim 1, wherein the one or more conductive walls are capacitively coupled with at least one of the first conductive patches.

7. The electronic device of claim 1, wherein the second conductive patch is formed in a shape having a four-direction symmetrical structure.

8. The electronic device of claim 7, wherein an arrangement area of the first conductive patches has a same layout as an initial layout after rotating.

9. An electronic device comprising:

a housing including a first plate, a second plate facing a direction opposite to the first plate, and a lateral member surrounding a space between the first plate and the second plate and connected to or integrally formed with the second plate;

a printed circuit board disposed in the space of the housing, including a first surface and a second surface facing a direction opposite to the first surface, including a first area and a second area surrounded by the first area when viewed from above the first surface, and including:

a plurality of insulating layers disposed between the first surface and the second surface;

first conductive patches overlapped at least in part with the first area, when viewed from above the first surface, and disposed on the first surface or disposed on an insulating layer between the first surface and the second surface closer to the first surface than the second surface;

a second conductive patch overlapped at least in part with the second area, when viewed from above the first surface, and disposed on an insulating layer;

at least one ground layer disposed on the second surface or on an insulating layer between the second conductive patch and the second surface; and one or more conductive walls extended from at least a portion of an outer periphery of the first area, when viewed from above the first surface, and disposed at a position so as to be capacitively coupled with the first conductive patches; and at least one wireless communication circuit electrically connected to the second conductive patch through the plurality of insulating layers and configured to at least one of transmit or receive a signal having a frequency between 3 GHz and 100 GHz, wherein the second conductive patch is capacitively coupled with at least one of the first conductive patches.

10. The electronic device of claim 9, wherein, when viewed from above the first surface, the first conductive patches and the second conductive patch are disposed on different insulating layers, and wherein when viewed from above the first surface, the first conductive patches are overlapped at least in part with the second conductive patch.

11. The electronic device of claim 9, wherein the first conductive patches and the second conductive patch are disposed on a same insulating layer.

12. The electronic device of claim 9, wherein the conductive walls are disposed, in a direction perpendicular to the first surface, closer to the first conductive patches than the second conductive patch.

13. The electronic device of claim 9, wherein the conductive walls are disposed, in a direction perpendicular to the first surface, farther to the first conductive patches than the second conductive patch.

14. The electronic device of claim 9, wherein the wireless communication circuit is disposed on the second surface.

15. The electronic device of claim 9, wherein the one or more conductive walls include a plurality of conductive vias vertically penetrating at least a portion of insulating layers of the printed circuit board.

16. The electronic device of claim 9, wherein the second conductive patch is formed in a shape having a four-direction symmetrical structure.

17. The electronic device of claim 16, wherein an arrangement area of the first conductive patches has a same layout as an initial layout after rotating.

18. The electronic device of claim 9, further comprising:

a display disposed in the space of the housing so as to be visible from outside the housing through at least a part of the first plate.

* * * * *